US005166044A

United States Patent [19]

Asami

[11] Patent Number: 5,166,044

[45] Date of Patent: Nov. 24, 1992

[54] SILVER HALIDE EMULSION AND PHOTOGRAPHIC MATERIAL USING SAME

[75] Inventor: Masahiro Asami, Minami-ashigara, Japan

[73] Assignee: Fuji Photo Film Co., Ltd., Kanagawa, Japan

[21] Appl. No.: 628,352

[22] Filed: Dec. 17, 1990

[30] Foreign Application Priority Data

Dec. 18, 1989 [JP] Japan ..... 1-327714

[51] Int. Cl.[5] ..... G03C 1/09

[52] U.S. Cl. ..... 430/567; 430/604; 430/605; 430/608

[58] Field of Search ..... 430/604, 608, 567, 605

[56] References Cited

U.S. PATENT DOCUMENTS 4,939,080 7/1990 Hioki et al. ..... 430/567

5,051,344 9/1991 Kuno ..... 430/567

FOREIGN PATENT DOCUMENTS 0325235 7/1989 European Pat. Off. ..... 430/567

*Primary Examiner*—Charles L. Bowers, Jr.

*Assistant Examiner*—Mark F. Huff

*Attorney, Agent, or Firm*—Burns, Doane, Swecker & Mathis

[57] ABSTRACT

There are disclosed a silver halide emulsion and a silver halide photographic material using same. The silver halide emulsion comprises high-silver-chloride grains that have localized phases containing iron ions and iridium ions each in a limited amount. The disclosure as described provides a silver halide emulsion and a silver halide photographic material that are excellent in rapid processibility, high in sensitivity and contrast, less in the change of sensitivity due to a change of exposure illuminance.

13 Claims, No Drawings

SILVER HALIDE EMULSION AND PHOTOGRAPHIC MATERIAL USING SAME

FIELD OF THE INVENTION

The present invention relates to photographic materials using a surface latent image type-silver halide photographic emulsion, and more particularly to a silver halide photographic material providing excellent rapid processibility, high sensitivity and contrast, and reduced gradation change with a change of illuminance at exposure, as well as less change in development density with time from exposure to development processing.

BACKGROUND OF THE INVENTION

Presently, photographic materials using a silver halide photographic emulsion are used for various purposes in the market, and the market scale has been increasingly expanding.

In a market for photographic materials, particularly photographic materials for color prints, characterized by a strong demand for large print volumes short delivery times, shortening development processing time is directly linked to improving production efficiency for prints. As such many studies have been made to increase developing speed.

In particular, it is well known that an increase in the silver chloride content of silver halide emulsions used in photographic materials brings about a great improvements in the developing speed.

However, it is also known that when emulsions high in silver chloride content are used, fogging is high, high sensitivity is difficult to obtain, and there is a large occurrence of so-called reciprocity failure, where sensitivity changes due to a change in exposure illuminance.

Various techniques are disclosed to overcome the above defects involved in silver halide emulsions having high silver chloride contents (hereinafter referred to as high silver-chloride emulsions).

For example, JP-A ("JP-A" means unexamined published Japanese patent application) Nos. 95736/1983, 108533/1983, 222844/1985, and 222845/1985 disclose that, in order to render high-silver-chloride emulsions highly sensitive, various grain structures, for example, those having a layer high in silver bromide content, are provided in silver halide grains. However, the inventor's study has revealed that although high sensitivity can be obtained according to these techniques, when pressure is exerted on the emulsion grains, desensitization is liable to occur, which is a great defect in practice. It has also been found that by these techniques it is difficult to adequately reduce reciprocity failure associated with high-silver-chloride emulsions.

For example, JP-A Nos. 139323/1986 and 171947/1984 or British Patent No. 2109576 A indicate that if a compound of a metal of Group VIII is contained, high sensitivity can be obtained and reciprocity failure can be lessened. JP-B ("JP-B" means examined Japanese patent publication) No. 33781/1974, JP-A Nos. 23618/1975, 18310/1977, 15952/1983, 214028/1984, and 67845/1986, German Patent Nos. 2,226,877 and 2,708,466, and U.S. Pat. No. 3,703,584 indicate that when a rhodium compound or an iridium compound is included, gradation can be made hard and reciprocity failure can be reduced. However, when a rhodium compound is used, although an emulsion whose gradation is hard can be obtained, considerable desensitization takes place, which is undesirable in practice. Further, in a high-silver-chloride emulsion containing an iridium compound, remarkable latent image intensification takes place in a relatively short period of time, (i.e., in 15 sec to about 2 hours after exposure), as disclosed by Twicky in *Journal of Photographic Science*, Vol. 33, page 201. If such a phenomenon occurs, the development density will change conspicuously with the lapse of time from exposure of the photographic material to its processing. That is also undesirable in practice.

Further, U.S. Pat. No. 4,269,927 indicates that when cadmium, lead, copper, zinc, or a mixture of these is contained within surface latent image-type high silver-chloride emulsion grains whose silver chloride content is 80 mol % or over, high sensitivity can be obtained. However, this provides only a little effect in terms of increasing sensitivity or reducing reciprocity failure, and they have not provided emulsions of improved practical performance.

JP-B No. 35373/1973 indicates that when a water-soluble iron compound is contained in a silver chloride emulsion obtained by normal precipitation, a black and white photographic paper whose gradation is hard can be obtained inexpensively. However, in this method, if the amount of the iron compound is increased to obtain high sensitivity, desensitization is liable to take place when the emulsion undergoes pressure, resulting in a practically inadequate effect.

Further, JP-A No. 105940/1989 discloses a technique for lessening reciprocity failure by co-depositing an iridium compound to be contained in a high-silver-chloride emulsion together with silver bromide localized phases having a silver bromide content of 20 mol % without causing latent image sensitization. However, for example, this technique cannot reduce the reciprocity failure of emulsions made up of pure silver chloride, and a change, for example, in the reaction condition under which silver bromide localized phases are co-deposited will result in latent image sensitization. This technique is desired to be improved further.

SUMMARY OF THE INVENTION

Therefore, the first object of the present invention is to provide a silver halide emulsion providing excellent rapid processibility and high sensitivity and contrast, and to provide a photographic material containing same.

The second object of the present invention is to provide a silver halide emulsion providing less change of gradation and sensitivity due to a changes of exposure illuminance, and to provide a photographic material containing same.

The third object of the present invention is to provide a silver halide emulsion providing less change of development density with a change in the time interval between exposure and development processing, and to provide a photographic material containing same.

Other and further objects, features and advantages of the present invention will appear more evident from the following description.

DETAILED DESCRIPTION OF THE INVENTION

The above objects of the present invention have been accomplished effectively by providing the following silver halide emulsion and photographic material containing the same.

1. A surface latent image type-silver halide emulsion, comprising silver halide grains of silver chloride or silver chlorobromide, 90 mol % or more of which is made up of silver chloride, and which is substantially free from silver iodide, wherein the silver halide grains contain iron ions in an amount of $1\times10^{-7}$ to $1\times10^{-3}$ mol and iridium ions in an amount of $1\times10^{-9}$ to $1\times10^{-5}$ mol, per mol of the silver halide, the silver halide grains have a localized phase wherein iron ion concentration is 10 times or more larger than parts present in the surface layer which occupies 50% or less of the grain volume, and 80% or more of said iridium ions are contained in the said iron ion localized phases.

2. A silver halide emulsion stated under 1, characterized in that the contained silver halide is silver chlorobromide, 90 mol % or more of which is made up of silver chloride, and which is substantially free from silver iodide, and silver bromide localized phases whose silver bromide content is 10 to 70 mol % are present within the silver halide grains or on the surface of the silver halide grains.

3. A silver halide photographic material which contains a support having thereon at least one photosensitive emulsion layer comprising the silver halide emulsion defined under 1 or 2.

The present invention will now be further described in detail.

The silver halide emulsion of the present invention comprises silver chloride or silver chlorobromide, 90 mol % or more of which is made up of silver chloride, and which is substantially free from silver iodide. By "substantially free from silver iodide" is meant that the silver iodide content is 0.5 mol % or less, preferably 0.1 mol % or less, and more preferably nil. It is required that the silver chloride content is 90 mol % or more, but preferably the silver chloride content is 95 mol % or more and more preferably 98 mol % or more. An emulsion made up of pure silver chloride but containing iron ions and iridium ions as dopants is also preferable.

If the silver halide emulsion of the present invention contains silver bromide, preferably the silver bromide takes the form of silver bromide localized phases whose silver bromide content is 10 to 70 mol %, and these phases are present within the grains or on the surfaces of the grains.

In the present invention, in order to incorporate iron ions into silver halide emulsion grains, a water-soluble iron compound can easily be allowed to be present in the step of forming emulsion grains. The iron compound is a compound containing a divalent iron ion or trivalent iron ion, and preferably it is soluble in water within the range wherein it is used in the present invention. Particularly preferably the iron compound is an iron complex salt that can be easily incorporated into silver halide grains. Specific examples of the iron compound are shown below, but the effect of the present invention is not limited by them:

Ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric albuminate, ammonium ferric acetate, ferric bromide, ferric chloride, ferric chromate, ferric citrate, ferric fluoride, ferric formate, ferric glycerophosphate, ferric hydroxide, acid ferric phosphate, ferric nitrate, ferric phosphate, ferric pyrophosphate, sodium ferric pyrophosphate, ferric thiocyanate, ferric sulfate, ammonium ferric sulfate, guanidium ferric sulfate, ammonium ferric citrate, potassium hexacyanoferrate (II), potassium pentacyanoammine iron (II), sodium ethylenedinitrilo-tetraacetic acid iron (III), potassium hexacyanoferrate (III), tris(bipyridyl)iron (II) chloride, and potassium pentacyanonitrosylferrate (III).

Of these compounds, in particular, a hexacyanoferrate (II), a hexacyanoferrate (III), ferrous thiocyanate, or ferric thiocyanate exhibits a remarkable effect.

The above iron compound is incorporated in grains by allowing the iron compound to be present in a dispersion medium (gelatin or a polymer having the nature of protective colloids) solution, an aqueous halide solution, an aqueous silver salt solution, or other aqueous solution at the time of the formation of silver halide grains.

In the present invention, the amount of the iron compound is in the range of $1\times10^{-7}$ to $1\times10^{-3}$ mol, more preferably $1\times10^{-6}$ to $5\times10^{-4}$ mol, per mol of the silver halide.

In the present invention, it is required that the iron compound is concentrated in the surface layer that occupies 50% or less of the grain volume of the silver halide grain. By "the surface layer that occupies 50% or less of the grain volume" is meant the surface part corresponding to the volume of 50% or less of the volume of one grain. Preferably the volume of the surface layer is 40% or less, more preferably 20% or less. By decreasing the volume of the surface layer (by making the surface layer thin) as much as possible, the effect of the present invention can be exhibited notably.

To incorporate iron ions in the surface layer in a concentrated manner, an iron compound is supplied, after the formation of silver halide grain cores, in concert with the supply of a water-soluble halide solution and a water-soluble silver salt solution for forming the surface layer.

In the present invention, if the volume ratio of the surface layer into which iron ions are contained is too large, when pressure is applied to the emulsion grains, desensitization is liable to occur and high sensitivity is difficult to obtain.

In order to allow the effect of the present invention to be exhibited, although the phases to which iron ions will be contained are limited to the surface layer taking 50% or less of the grain volume, part of iron ions may be contained in core parts of the grains. However, in that case it is required that the iron ion concentration of the grain surface layer is 10 times or more the iron ion concentration of the grain core part. If the iron ion concentration of the grain core part exceeds the above amount, when the emulsion grains undergo pressure, desensitization is liable to occur and the effect of the present invention is difficult to obtain.

In the present invention, the amount of iron ions to be contained in silver halide grains is preferably in the range mentioned above. If the amount is too far below the amount defined by the present invention, the effect is difficult to obtain, whereas if the amount is excessive, desensitization due to pressure is apt to occur.

In the present invention, in order to incorporate iridium ions in silver halide emulsion grains, a water-soluble iridium compound can easily be allowed to be present in the step of forming emulsion grains. The iridium compound is a compound containing a trivalent or tetravalent iridium ion, and it is preferably soluble in water in the range in which the compound is used in the present invention. It is particularly preferable to use an iridium complex salt that can be easily incorporated within silver halide grains. Such a compound includes, for example, an iridium (III) halide compound, an iridium (IV) halide compound, and an iridium complex salt having halogens, amines or oxalate as at least one ligand, such as hexachloroiridium (III) or (IV) complex salt, hexaammineiridium (III) or (IV) complex salt, and trioxalatoiridium (III) or (IV) complex salt.

In the present invention, among these compounds, a III-valent compound and a IV-valent compound may be used arbitrarily in combination. Although suitably these iridium compounds are used in the form of an aqueous solution, the generally commonly used method of stabilizing the solution of an iridium compound can be used, wherein an aqueous hydrogen halide solution (e.g., hydrochloric acid, hydrobromic acid, and hydrofluoric acid) or an alkali halide is (e.g., potassium chloride, sodium chloride, potassium bromide, and sodium bromide) is added.

The iridium compound is incorporated in grains by allowing the compound to be present in a dispersion medium (gelatin or a polymer having the nature of protective colloids) solution, an aqueous halide solution, an aqueous silver salt solution, or other aqueous solution at the time of the formation of silver halide grains.

In the present invention, the amount of the iridium compound is in the range of $1\times10^{-9}$ to $1\times10^{-5}$ mol, more preferably $5\times10^{-9}$ to $1\times10^{-6}$ mol, per mol of the silver halide.

It is required that at least 80% of the iridium compound used in the present invention are contained in the iron ion localized phases mentioned above. More preferably all of the iridium compound to be added is contained in the iron ion localized phases. If the iridium ions are contained in parts other than the iron ion localized phases, the development density increases notably with the lapse of time from exposure to the development processing and the effect of the present invention is difficult to obtain.

Control of the parts where the iridium compound is to be added can be carried out by supplying a solution of the iridium compound to be used simultaneously with the solution of the iron ion containing compound mentioned above to the system where the reaction of the formation of grains will take place.

In the present invention, for the purpose of obtaining high sensitivity and high contrast, a compound containing a polyvalent metal ion other than iron and iridium ions can be additionally contained in the silver halide grains. As examples thereof, ions of metals of Group VIII, such as cobalt, nickel, ruthenium, rhodium, palladium, osmium, and platinum can be mentioned. Ions of such metals as copper, gold, zinc, cadmium, and lead can also be additionally used.

The amount of these compounds to be added varies over a wide range to meet the purpose, preference being given to $10^{-9}$ to $10^{-2}$ mol for the silver halide.

The average grain size of the silver halide grains contained in the silver halide emulsion used in the present invention (the average grain size being the average number obtained when assuming the diameters of circles equivalent to the projected areas of the grains to be the grain sizes) is preferably 0.1 to 2 μm.

Preferably the grain size distribution is one having a deviation coefficient (which is obtained by dividing the standard deviation of the grain size distribution by the average grain size) of 20% or less, and desirably 15% or less, that is, a so-called monodisperse distribution. In this case, in order to obtain wide latitude, also preferably the above-mentioned monodisperse emulsions are blended and used in the same layer, or are applied as layers one upon the other.

The shape of the silver halide grains contained in the photographic emulsion may be of a regular crystal form, such as cubic, tetradecahedral, or octahedral, or of an irregular crystal form, such as spherical or tabular, or mixture of these. The silver halide grains may be made up of a mixture of silver halide grains having various crystal forms. In the present invention, of these, grains are good wherein 50% or more, preferably 70% or more, and more preferably 90% or more, have the above regular crystal form.

In addition, emulsions can also be preferably used wherein tabular grains having an average aspect ratio (in terms of circle diameter/thickness) of 5 or over, preferably 8 or over, amount to more than 50% of all the grains in terms of projected area.

The silver chlorobromide emulsion used in the present invention can be prepared by the methods described, for example, by P. Glafkides in *Chimie et Phisique Photographique* (published by Paul Montel, 1967), by G. F. Duffin in *Photographic Emulsion Chemistry* (published by Focal Press, 1966), and by V. L. Zelikman et al. in *Making and Coating Photographic Emulsion* (Focal Press, 1964). That is, any method of the acid method, the neutral method, the ammonia method, etc., can be used, and as the type wherein a soluble silver salt and a soluble silver halide are reacted, any method of the single jet method, the double-jet method, the combined method of these, etc., can be used. Also the method wherein grains are formed in an atmosphere containing excess silver ions, that is, the so-called reverse precipitation method, can also be used. As one type of the reverse precipitation method, a method wherein the pAg in the liquid phase where the silver halide is formed is kept constant, that is, the so-called controlled double jet method, can also be used. Using the controlled double jet method, a silver halide emulsion wherein the crystal form is regular and the grain size is nearly uniform can be obtained.

Generally, the silver halide emulsion used in the present invention is chemically and spectrally sensitized.

As the chemical sensitization method, sulfur sensitization, typically by the addition of an unstable sulfur compound, noble metal sensitization, typically gold sensitization, or reduction sensitization can be used alone or in combination. As compounds used in the chemical sensitization, preferably those described in JP-A No. 215272/1987, page 18 (the right lower column) to page 22 (the right upper column), are used.

The spectral sensitization is carried out for the purpose of providing the emulsions of the layers of the photographic material of the present invention with spectral sensitivity in desired wavelength regions. In the present invention, the spectral sensitization is preferably carried out by adding dyes that absorb light in the wavelength ranges corresponding to the aimed for spectral sensitivities, that is, by adding spectrally sensitizing dyes. As the spectrally sensitizing dyes used herein, for example, those described by F. M. Harmer in *Heterocyclic compounds—Cyanine dyes and related compounds* (published by John Wiley & Sons [New York, London], 1964) can be mentioned. As specific examples of the compounds and the spectral sensitization method, those described in the above JP-A No. 215272/1987, page 22 (right upper column) to page 38, are preferably used.

In the silver halide emulsion used in the present invention, various compounds or their precursors can be added for the purpose of stabilizing the photographic performance or preventing fogging that will take place during the process of the production of the photographic material, or storage, or photographic processing of the photographic material. As specific examples of these compounds, those described in the above-mentioned JP-A No. 215272/1987, pages 39 to 72 are preferably used.

As the emulsion used in the present invention, use is made of the so-called surface-sensitive emulsion, wherein a latent image is formed mainly on the grain surface.

When the present invention is used for color photographic materials, generally in the color photographic material are used a yellow coupler, a magenta coupler, and a cyan coupler, which will couple with the oxidized product of the aromatic amine color-developing agent to form yellow, magenta, and cyan.

Cyan couplers, magenta couplers, and yellow couplers preferably used in the present invention are those represented by the following formulae (C-1), (C-II), (M-I), (M-II), and (Y):

Formula (C-I)

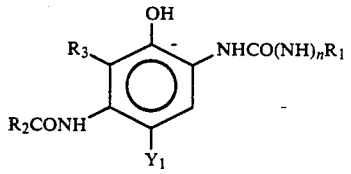

Formula (C-II)

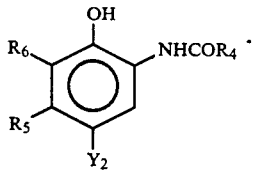

Formula (M-I)

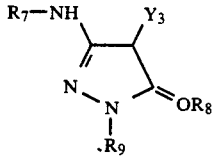

Formula (M-II)

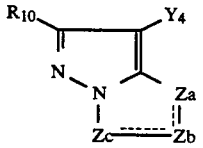

Formula (Y)

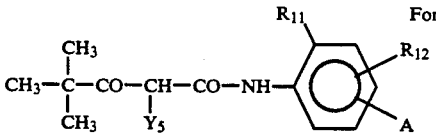

In formulae (C-I) and (C-II), $R_1$, $R_2$, and $R_4$ each represent a substituted or unsubstituted aliphatic, aromatic, or heterocyclic group, $R_3$, $R_5$, and $R_6$ each represent a hydrogen atom, a halogen atom, an aliphatic group, an aromatic group, or an acylamino group, $R_3$ and $R_2$ together may represent a group of nonmetallic atoms to form a 5- or 6-membered ring, $Y_1$ and $Y_2$ each represent a hydrogen atom or a group that is capable of coupling off with the oxidation product of a developing agent, and n is 0 or 1.

In formula (C-II), $R_5$ preferably represents an aliphatic group such as a methyl group, an ethyl group, a propyl group, a butyl group, a pentadecyl group, a tertbutyl group, a cyclohexyl group, a cyclohexylmentyl group, a phenylthiomethyl group, a dodecyloxyphenylthiomethyl group, a butaneamidomethyl group, and a methoxymethyl group.

Preferable examples of the cyan couplers represented by formulae (C-I) and (C-II) are given below:

In formula (C-I), preferable $R_1$ is an aryl group or a heterocyclic group, and more preferably an aryl group substituted by a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when $R_3$ and $R_2$ together do not form a ring, $R_2$ is preferably a substituted or unsubstituted alkyl group, or aryl group, and particularly preferably an alkyl group substituted by a substituted aryloxy, and preferably $R_3$ represents a hydrogen atom.

In formula (C-II), preferable $R_4$ is a substituted or unsubstituted alkyl group or aryl group, and particularly preferably an alkyl group substituted by a substituted aryloxy group.

In formula (C-II), preferable $R_5$ is an alkyl group having 2 to 15 carbon atoms, or a methyl group substituted by a substituent having 1 or more carbon atoms, and the substituent is preferably an arylthio group, an alkylthio group, an acylamino group, an aryloxy group, or an alkyloxy group.

In formula (C-II), preferably $R_5$ is an alkyl group having 2 to 15 carbon atoms, and particularly preferably an alkyl group having 2 to 4 carbon atoms.

In formula (C-II), preferable $R_6$ is a hydrogen atom or a halogen atom, and particularly preferably a chlorine atom or a fluorine atom. In formulae (C-I) and (C-II), preferable $Y_1$ and $Y_2$ each represent a hydrogen atom, a halogen atom, an alkoxy group, an aryloxy group, an acyloxy group, or a sulfonamido group.

In formula (M-I), $R_7$ and $R_9$ each represent an aryl group, $R_8$ represents a hydrogen atom, an aliphatic or aromatic acyl group, an aliphatic or aromatic sulfonyl group, and $Y_3$ represents a hydrogen atom or a coupling split-off group. Allowable substituents of the aryl group represented by $R_7$ and $R_9$ are the same substituents as those allowable for the substituent $R_1$, and if there are two substituents, they may be the same or different. $R_8$ is preferably a hydrogen atom, an aliphatic acyl group, or a sulfonyl group, and particularly preferably a hydrogen atom. Preferable $Y_3$ is of the type that will split-off at one of a sulfur atom, an oxygen atom, and a nitrogen atom, and particularly preferably of the sulfur atom split-off type described, for example, in U.S. Pat. No. 4,351,897 and International Publication Patent No. WO 88/04795.

In formula (M-II), $R_{10}$ represents a hydrogen atom or a substituent. $Y_4$ represents a hydrogen atom or a coupling split-off group, and particularly preferably a halogen atom or an arylthio group. Za, Zb, and Zc each represent methine, a substituted methine, =N—, or —NH—, and one of the Za-Zb bond and the Zb-Zc bond is a double bond, and the other is a single bond. If the Zb-Zc bond is a carbon-carbon double bond, it may be part of the aromatic ring. A dimer or more higher polymer formed through $R_{10}$ or $Y_4$ is included, and if Za, Zb, or Zc is a substituted methine, a dimer or more higher polymer formed through that substituted methine is included.

Of the pyrazoloazole couplers represented by formula (M-II), imidazo[1,2-b]pyrazoles described in U.S. Pat. No. 4,500,630 are preferable in view of reduced yellow subsidiary absorption of the color-formed dye and light-fastness, and pyrazolo[1,5-b][1,2,4]triazoles described in U.S. Pat. No. 4,540,654 are particularly preferable.

Further, use of pyrazolotriazole couplers wherein a branched alkyl group is bonded directly to the 2-, 3-, or 6-position of a pyrazolotriazole ring, as described in JP-A No. 65245/1976, pyrazoloazole couplers containing a sulfonamido group in the molecule, as described in JP-A No. 65246/1986, pyrazoloazole couplers having an alkoxyphenylsulfonamido ballasting group, as described in JP-A No. 147254/1986, and pyrazolotriazole couplers having an aryloxy group or an alkoxy group in the 6-position, as described in European Patent (Publication) Nos. 226,849 and 294,785, is preferable.

In formula (Y), $R_{11}$ represents a halogen atom, an alkoxy group, a trifluoromethyl group, or an aryl group, and $R_{12}$ represents a hydrogen atom, a halogen atom, or an alkoxy group. A represents $—NHCOR_{13}$, $—NHSO_2—R_3$, $—SO_2NHR_{13}$, $—COOR_{13}$, or $$—SO_2\underset{\underset{R_{14}}{|}}{N}—R_{13},$$

wherein $R_{13}$ and $R_{14}$ each represent an alkyl group, an aryl group, or an acyl group. $Y_5$ represents a coupling split-off group. Substituents of $R_{12}$, $R_{13}$, and $R_{14}$ are the same as those allowable for $R_1$, and the coupling split-off group $Y_5$ is of the type that will split off preferably at an oxygen atom or a nitrogen atom, and particularly preferably it is of the nitrogen atom split-off type.

Specific examples of couplers represented by formulae (C-I), (C-II), (M-I), (M-II) and (Y) are listed below.

(C-1)

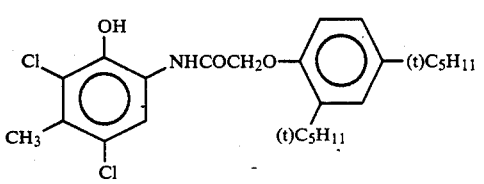

(C-2)

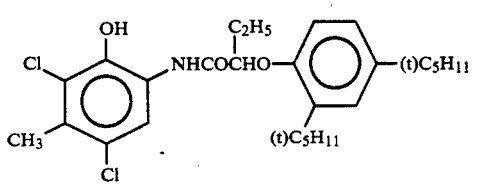

(C-3)

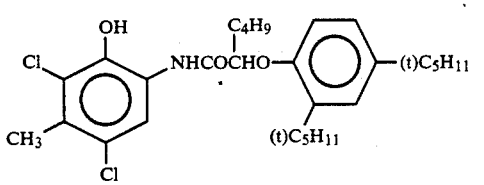

(C-4)

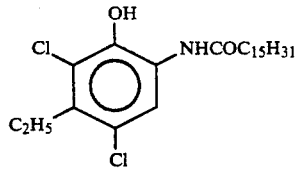

(C-5)

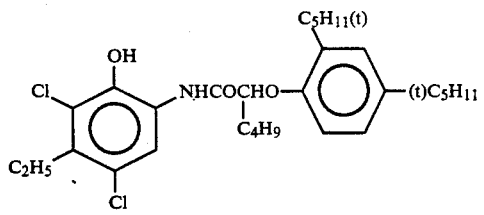

(C-6)

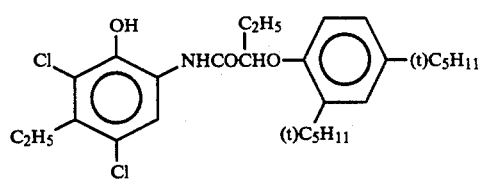

(C-7)

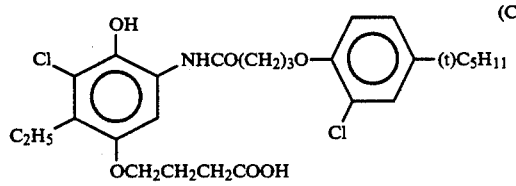

(C-8)

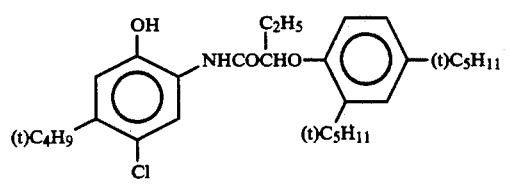

(C-9)

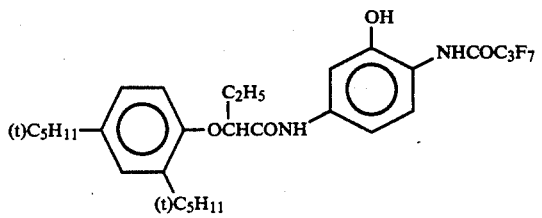

-continued
(C-10)
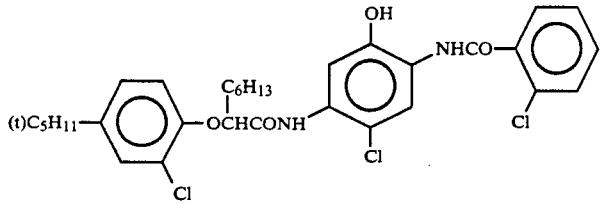
(C-11)
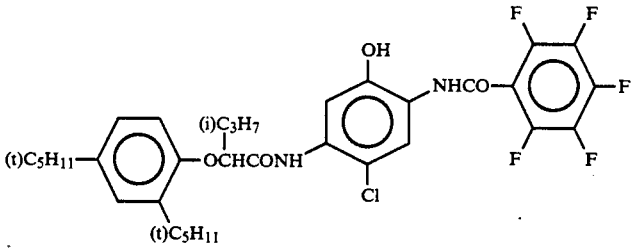
(C-12)
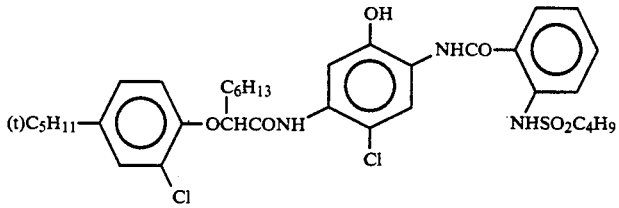
(C-13)
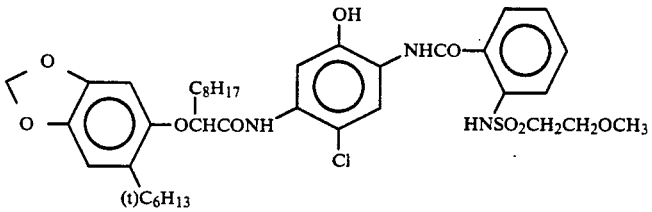
(C-14)
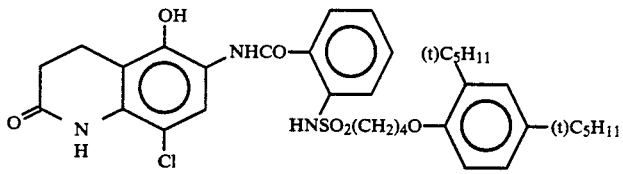
(C-15)
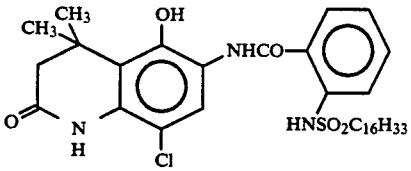
(C-16)
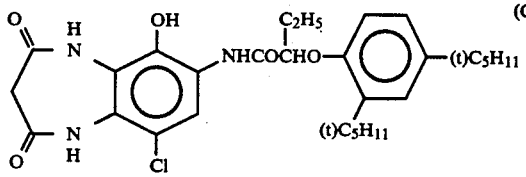
(C-17)
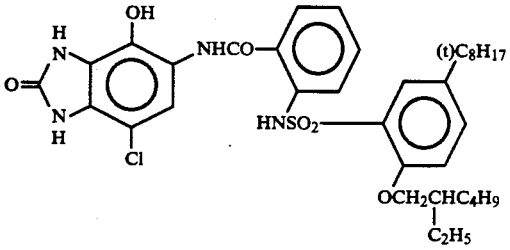

-continued
(C-18)
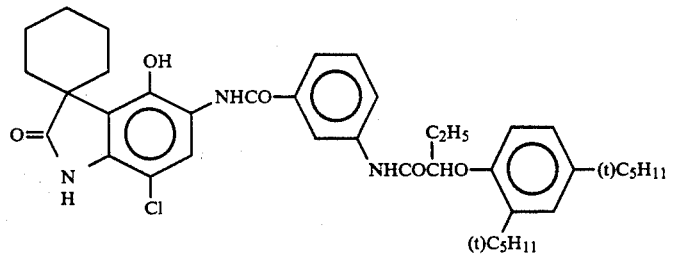
(C-19)
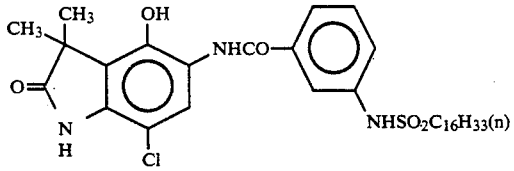
(C-20)
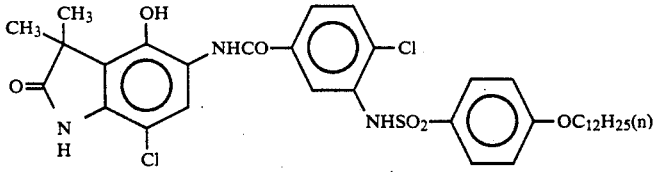
(C-21)
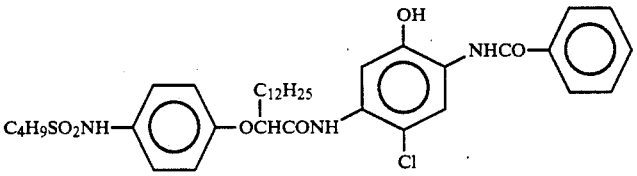
(C-22)
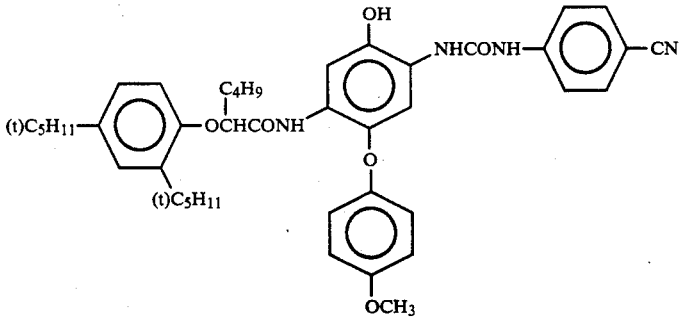
(M-1)
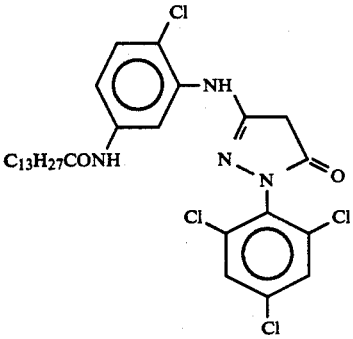
(M-2)
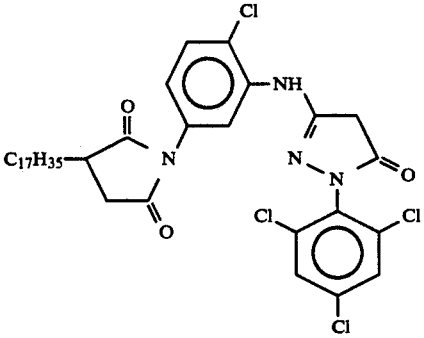

-continued
(M-3)
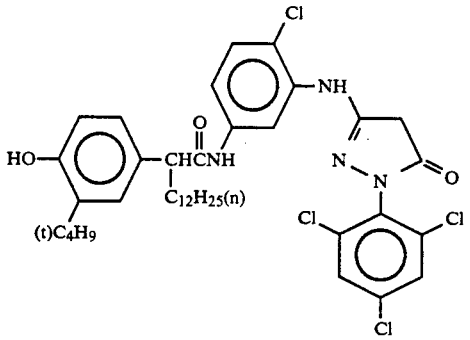
(M-4)
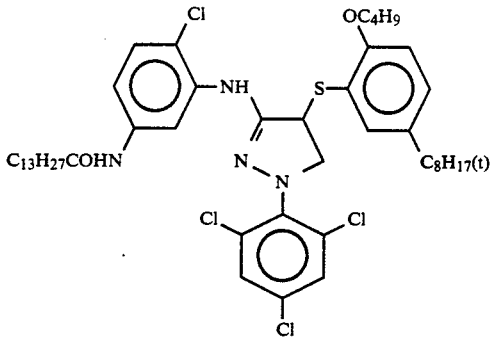
(M-5)
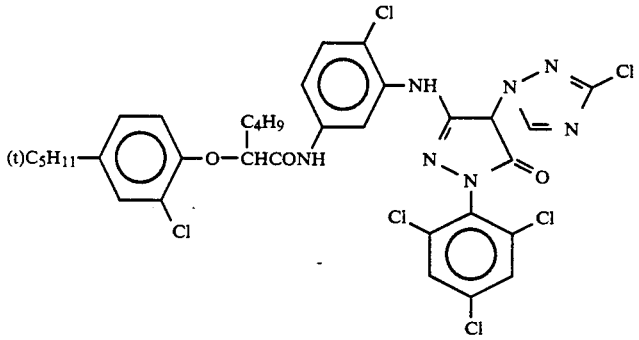
(M-6)
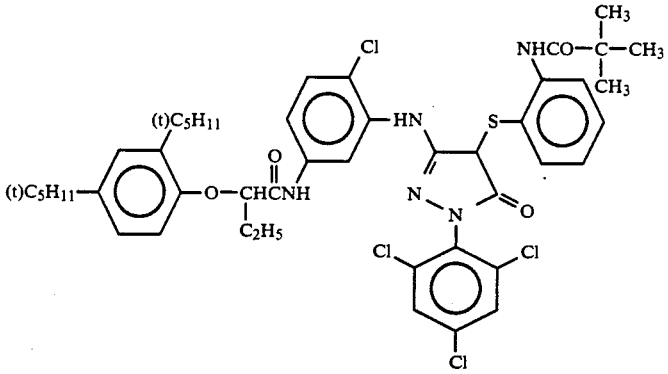
(M-7)
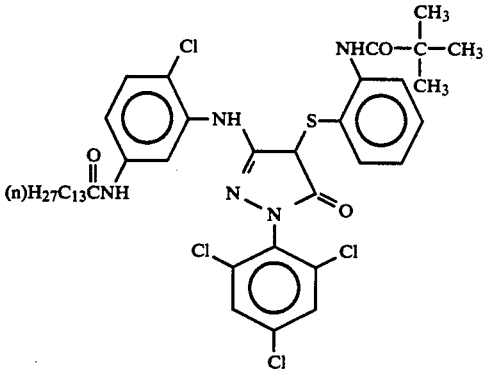

-continued
(M-8)
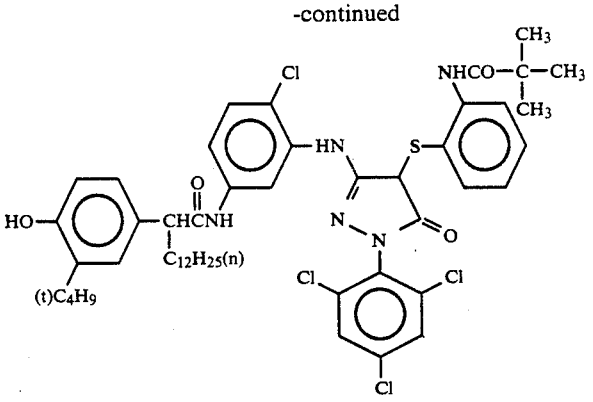

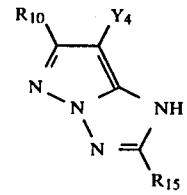
| Compound | $R_{10}$ | $R_{15}$ | $Y_4$ |
|---|---|---|---|
| M-9 | $CH_3$— | 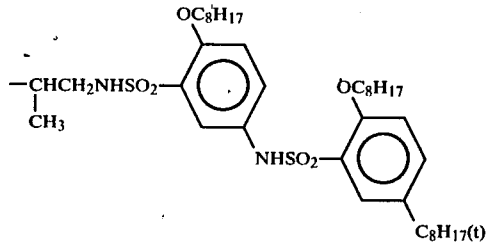 | Cl |
| M-10 | The same as the above | 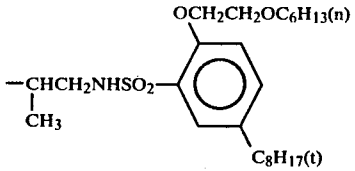 | The same as the above |
| M-11 | $(CH_3)_3C$— | 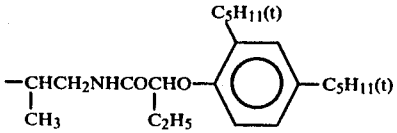 | 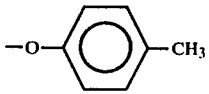 |
| M-12 | 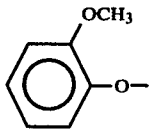 | 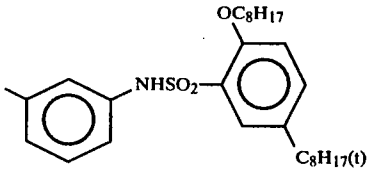 | 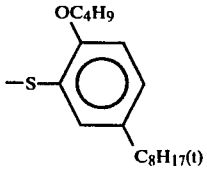 |

-continued
| | | | |
|---|---|---|---|
| M-13 | $CH_3$— | 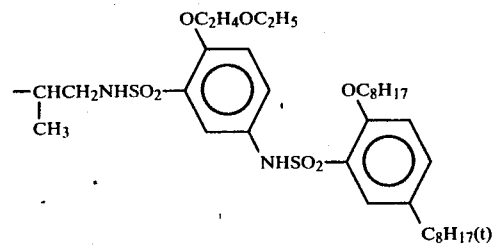 | Cl |
| M-14 | The same as the above | 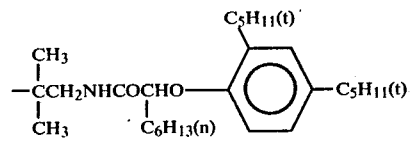 | The same as the above |
| M-15 | The same as the above | 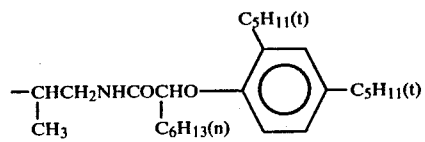 | The same as the above |
| M-16 | The same as the above | 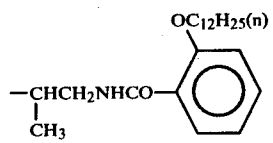 | The same as the above |
| M-17 | The same as the above | 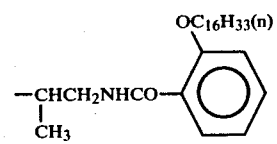 | The same as the above |

-continued
| | | | |
|---|---|---|---|
| M-18 | 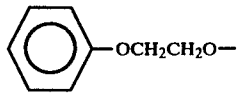 | 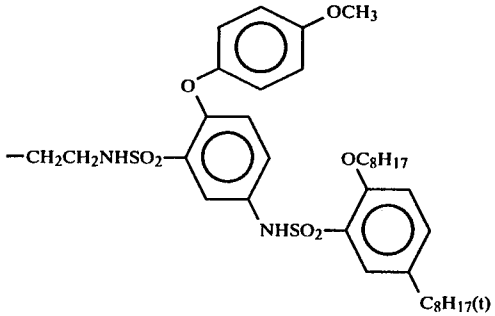 | 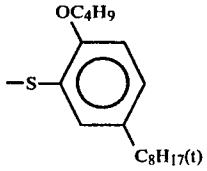 |
| M-19 | $CH_3CH_2O-$ | The same as the above | The same as the above |
| M-20 | 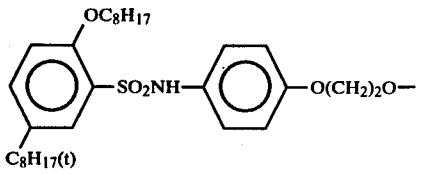 | 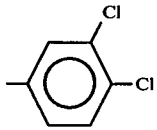 | 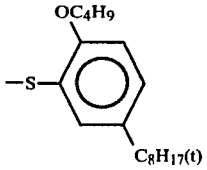 |
| M-21 | 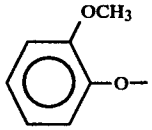 | 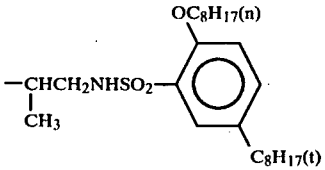 | Cl |
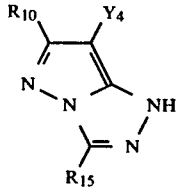
| Compound | $R_{10}$ | $R_{15}$ | $Y_4$ |
|---|---|---|---|
| M-22 | $CH_3-$ | 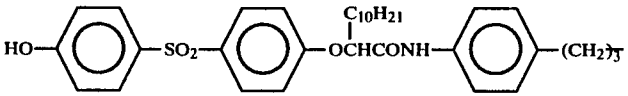 | Cl |

-continued
| | | | |
|---|---|---|---|
| M-23 | The same as the above | 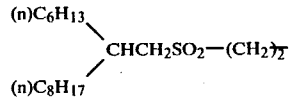 | The same as the above |
| M-24 | 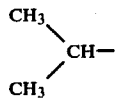 | 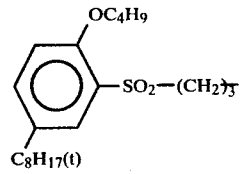 | The same as the above |
| M-25 | 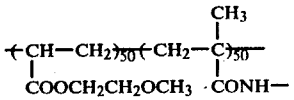 | 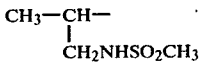 | The same as the above |
| M-26 | 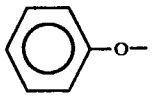 | 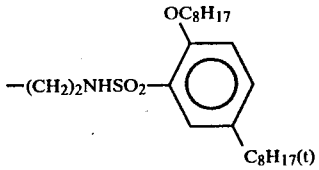 | The same as the above |
| M-27 | $CH_3$— | 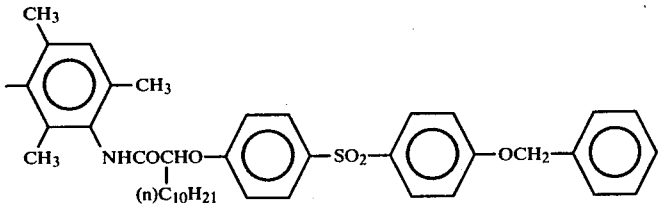 | Cl |
| M-28 | $(CH_3)_3C$— | 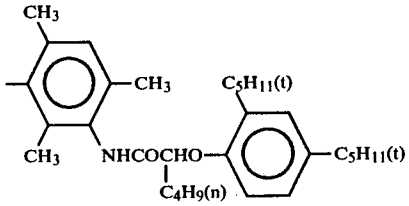 | The same as the above |

-continued
| | | | |
|---|---|---|---|
| M-29 | 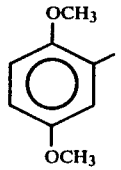 | 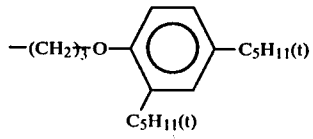 | The same as the above |
| M-30 | $CH_3-$ | $-\underset{\underset{C_2H_5}{\vert}}{CH}-\overset{\overset{(n)C_{18}H_{37}}{\vert}}{N}COCH_2CH_2COOH$ | The same as the above |

(Y-1)
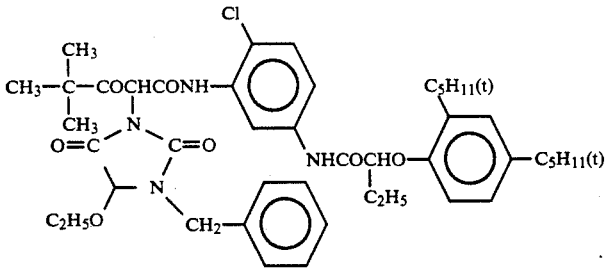
(Y-2)
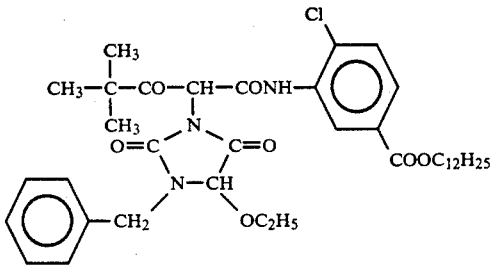
(Y-3)
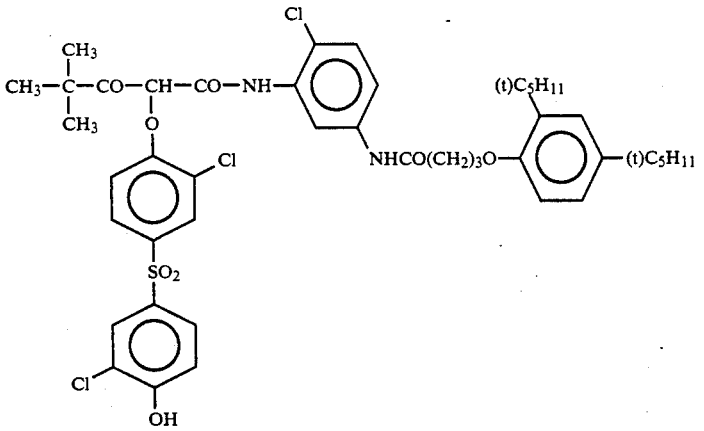
(Y-4)
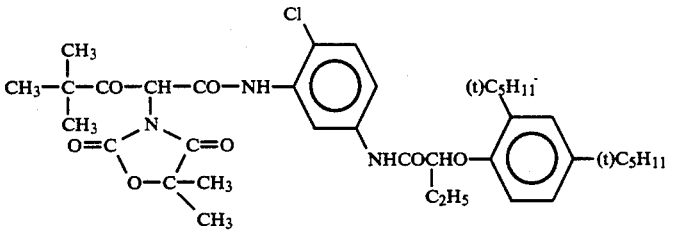
(Y-5)
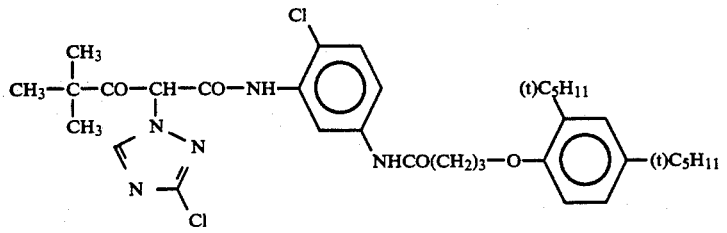

-continued (Y-6)

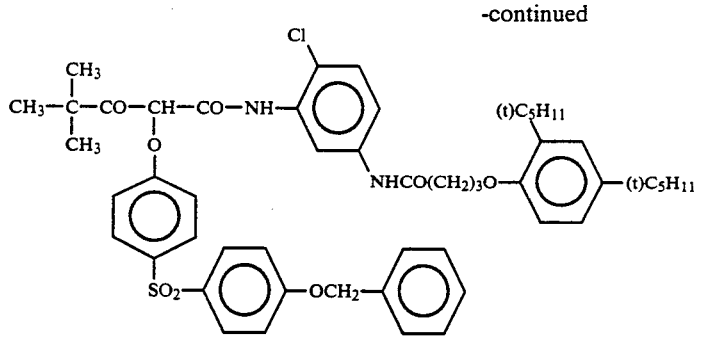

(Y-7)

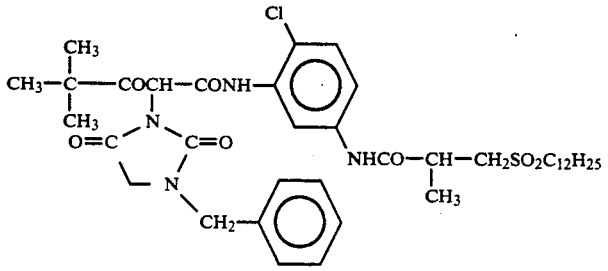

(Y-8)

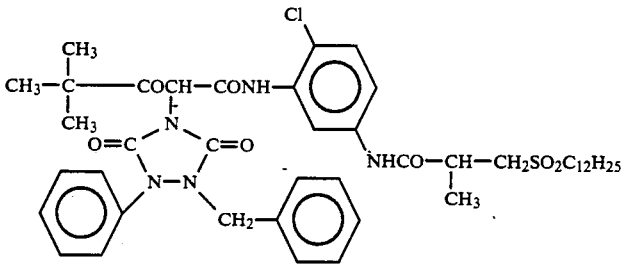

(Y-9)

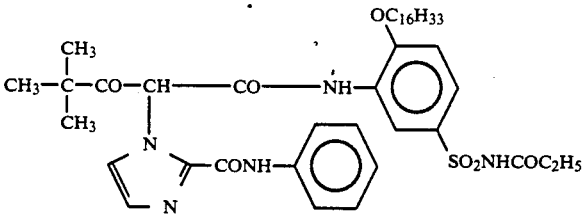

The color photographic material of the present invention may be made by applying on a base at least one blue-sensitive silver halide emulsion layer, at least one green-sensitive silver halide emulsion layer, and at least one red-sensitive silver halide emulsion layer. Generally, in color papers, it is common that the emulsion layers are applied in the above-stated order, although the order may be different therefrom. An infrared-sensitive silver halide emulsion layer can be used instead of at least one of the above emulsion layers. By incorporating, into the photosensitive emulsion layers, silver halide emulsions sensitive to respective wavelength regions, and dyes complementary to the lights to which they are sensitive, that is, so-called color couplers for forming yellow for blue, magenta for green, and cyan for red, color reproduction of the subtractive color process can be effected. However, the photosensitive layers and the color-forming hues of the couplers may be constituted not to have the above correspondence.

The couplers represented by formulae (C-I) to (Y) are contained in the silver halide emulsion layer constituting the photographic layer generally in an amount of 0.1 to 1.0 mol, preferably 0.1 to 0.5 mol, per mol of the silver halide.

In the present invention, in order to add the coupler to the photographic layer, various known techniques can be applied. Generally, the oil-in-water dispersion method known, as the oil-protect method, can be used for the addition, that is, after the coupler is dissolved in a solvent, it is emulsified and dispersed into an aqueous gelatin solution containing a surface-active agent. Alternatively, it is also possible that the coupler solution containing a surface-active agent can be added to water or an aqueous gelatin solution to form an oil-in-water dispersion with phase reversal of the emulsion. In the case of an alkali-soluble coupler, it can be dispersed by the so-called Fisher dispersion method. It is also possible that the low-boiling organic solvent can be removed from the coupler dispersion by means of distillation, noodle washing, ultrafiltration, or the like, followed by mixing with the photographic emulsion.

As the dispersion medium for the couplers, it is preferable to use a high-boiling organic solvent and/or a water-insoluble polymer compound having a dielectric constant of 2 to 20 (25° C.) and a refractive index of 1.5 to 1.7 (25° C.).

As the high-boiling organic solvent, a high-boiling organic solvent represented by the following formula (A'), (B'), (C'), (D'), or (E') is preferably used.

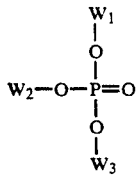

Formula (A')

$W_1-COO-W_2$ Formula (B')

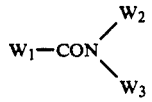

Formula (C')

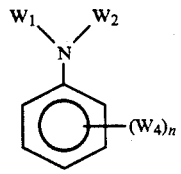

Formula (D')

$W_1-O-W_2$ Formula (E')

wherein $W_1$, $W_2$, and $W_3$ each represent a substituted or unsubstituted alkyl group, cycloalkyl group, alkenyl group, aryl group or heterocyclic group, $W_4$ represents $W_1$, $OW_1$ or $S-W_1$, n is an integer of 1 to 5, when n is 2 or over, $W_4$ groups may be the same or different, and in formula (E'), $W_1$ and $W_2$ may together form a condensed ring.

As the high-boiling organic solvent used in the present invention, any compound other than compounds represented by formulae (A') to (E') can also be used if the compound has a melting point of 100° C. or below and a boiling point of 140° C. or over, and if the compound is incompatible with water and is a good solvent for the coupler. Preferably the melting point of the high-boiling organic solvent is 80° C. or below. Preferably the boiling point of the high-boiling organic solvent is 160° C. or over, and more preferably 170° C. or over.

Details of these high-boiling organic solvents are described in JP-A No. 215272/1987, page 137 (the right lower column) to page 144 (the right upper column).

The couplers can also be emulsified and dispersed into an aqueous hydrophilic colloid solution by impregnating them into a loadable latex polymer (e.g., U.S. Pat. No. 4,203,716) in the presence or absence of the above-mentioned high-boiling organic solvent, or by dissolving them in a polymer insoluble in water and soluble in organic solvents.

Preferably, homopolymers and copolymers described in International Publication Patent No. WO 88/00723, pages 12 to 30, are used, and particularly the use of acrylamide polymers is preferable because, for example, dye images are stabilized.

The photographic material that is prepared by using the present invention may contain, as color antifoggant, for example, a hydroquinone derivative, an aminophenol derivative, a gallic acid derivative, or an ascorbic acid derivative.

In the photographic material of the present invention, various anti-fading agent (discoloration preventing agent) can be used. That is, as organic anti-fading additives for cyan, magenta and/or yellow images, hydroquinones, 6-hydroxychromans, 6-hydroxycoumarans, spirochromans, p-alkoxyphenols, hindered phenols, including bisphenols, gallic acid derivatives, methylenedioxybenzenes, aminophenols, hindered amines, and ether or ester derivatives obtained by silylating or alkylating the phenolic hydroxyl group of these compounds can be mentioned typically. Metal complexes such as (bissalicylaldoximato)nickel complex and (bis-N,N-dialkyldithiocarbamato)nickel complexes can also be used.

Specific examples of the organic anti-fading agents are described in the following patent specifications:

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337 and JP-A No. 152225/1987; spiroindanes are described in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. No. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079 and 4,332,886, and JP-B No. 21144/1981 respectively; hindered amines are described, for example, in U.S. Pat. Nos. 3,336,135, 4,268,593, British Patent Nos. 1,326,889, 1,354,313, and 1,410,846, JP-B No. 1420/1976, and JP-A Nos. 114036/1983, 53846/1984, and 78344/1984; and metal complexes are described, for example, in U.S. Pat. Nos. 4,050,938 and 4,241,155 and British Patent 2,027,731(A). To attain the purpose, these compounds can be added to the photosensitive layers by coemulsifying them with the corresponding couplers, with the amount of each compound being generally 5 to 100 wt % for the particular coupler. To prevent the cyan dye image from being deteriorated by heat, and in particular light, it is more effective to introduce an ultraviolet absorber into the cyan color-forming layer and the opposite layers adjacent to the cyan color-forming layers.

As the ultraviolet absorber, aryl-substituted benzotriazole compounds (e.g., those described in U.S. Pat. No. 3,533,794), 4-thiazolidone compounds (e.g., those described in U.S. Pat. Nos. 3,314,794 and 3,352,681), benzophenone compounds (e.g., those described in JP-A No. 2784/1971), cinnamic acid ester compounds (e.g., those described in U.S. Pat. Nos. 3,705,805 and 3,707,395), butadiene compounds (e.g., those described in U.S Pat. No. 4,045,229), or benzoxazole compounds (e.g., those described in U.S. Pat. Nos. 3,406,070, 3,677,672, and 4,271,207) can be used. Ultraviolet-absorptive couplers (e.g., α-naphthol type cyan dye forming couplers) and ultraviolet-absorptive polymers can, for example, be used also. These ultraviolet-absorbers may be mordanted in a particular layer.

In particular, the above-mentioned aryl-substituted benzotriazole compounds are preferable.

In the present invention, together with the above couplers, in particular together with the pyrazoloazole coupler, the following compounds are preferably used.

That is, it is preferred that a compound (F), which will chemically bond to the aromatic amine developing agent remaining after the color-developing process, to form a chemically inactive and substantially colorless compound, and/or a compound (G), which will chemically bond to the oxidized product of the aromatic amine color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate $k_2$ (in trioctyl phosphate at 80° C.) in the range of 1.0/mol·sec to $1\times10^{-5}$ /mol·sec. The second-order reaction-specific rate can be determined by the method described in JP-A No. 158545/1983.

If $k_2$ is over this range, the compound itself becomes unstable, and in some cases the compound reacts with gelatin or water to decompose. On the other hand, if k2 is below this range, the reaction with the remaining aromatic amine developing agent becomes slow, resulting, in some cases, in the failure to prevent the side effects of the remaining aromatic amine developing agent, which prevention is aimed at by the present invention.

More preferable as compound (F) are those that can be represented by the following formula (FI) or (FII): Formula (FI)

$$R_1-(A_1)_n-X$$

Formula (FII)

$$R_2-\underset{\underset{B_1}{|}}{C}=Y$$

wherein $R_1$ and $R_2$ each represent an aliphatic group, an aromatic group, or a heterocyclic group, n is 1 or 0, $A_1$ represents a group that will react with an aromatic amine developing agent to form a chemical bond therewith, X represents a group that will react with the aromatic amine developing agent and split off, $B_1$ represents a hydrogen atom, an aliphatic group, an aromatic group, a heterocyclic group, an acyl group, or a sulfonyl group, Y represents a group that will facilitate the addition of the aromatic amine developing agent to the compound represented by formula (FII), and $R_1$ and X, or Y and $R_2$ or $B_1$, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI): Formula (GI)

$$R_3-Z$$

wherein $R_3$ represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic $^nCH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987 and 229145/1987, Japanese Patent Application No. 136724/1988, and European Published Patent Nos. 298321 and 277589.

Details of combinations of compound (G) and compound (F) are described in European Published Patent No. 277589.

The photographic material prepared in accordance with the present invention may contain, in the hydrophilic colloid layer, water-soluble dyes as filter dyes or to prevent irradiation, and for other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin.

As the other reflection base, a base having a metal surface of mirror reflection or secondary diffuse reflection may be used. A metal surface having a spectral reflectance in the visible wavelength region of 0.5 or more is preferable and the surface as preferably made to show diffuse reflection by roughening the surface or by using a metal powder. The surface may be a metal plate, metal foil or metal thin layer obtained by rolling, vapor deposition or galvanizing of metal such as, for example, aluminum, tin, silver, magnesium and alloy thereof. Of these, a base obtained by vapor deposition of metal is preferable It is preferable to provide a layer of water resistant resin, in particular, a layer of thermoplastic resin. The opposite side to metal surface side of the base according to the present invention is preferably provided with an antistatic layer. The details of such base are described, for example, in JP-A Nos. 210346/1986, 24247/1988, 24251/1988 and 24255/1988.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 $\mu m \times 6$ $\mu m$, and measuring the occupied area ratio (%) (Ri) of the finely divided particles projected onto the unit areas. The deviation coefficient of the occupied area ratio (%) can be obtained based on the ratio $s/\overline{R}$, wherein s stands for the standard deviation of Ri, and $\overline{R}$ stands for the average value of Ri. Preferably, the number (n) of the unit areas to be subjected is 6 or over. Therefore, the deviation coefficient $s/\overline{R}$ can be obtained by $$\sqrt{\frac{\sum_{i=1}^{n}(R_i - R)^2}{n-1}} \Big/ \frac{\sum_{i=1}^{n} R_i}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

It is preferable that the present color photographic material is color-developed, bleach-fixed, and washed (or stabilized). The bleach and the fixing may not be effected in the single bath described above, but may be effected separately.

The color developer used in the present invention contains an aromatic primary amine color-developing agent. As the color-developing agent conventional ones can be used. Preferred examples of aromatic primary amine color-developing agents are p-phenylenediamine derivatives. Representative examples are given below, but they are not meant to limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl)amino]-aniline
D-6: 4-amino-3-methyl-N-ethyl-N-[β-(methanesulfonamido)ethyl]-aniline
D-7: N-(2-amino-5-diethylaminophenylethyl)methanesulfonamide
D-8: N,N-dimethyl-p-phenylenediamine
D-9: 4-amino-3-methyl-N-ethyl-N-methoxyethylaniline
D-10: 4-amino-3-methyl-N-ethyl-N-β-ethoxyethylaniline
D-11: 4-amino-3-methyl-N-ethyl-N-β-butoxyethylaniline Of the above-mentioned p-phenylenediamine derivatives, 4-amino-3-methyl-N-ethyl-N-[β-(methanesulfonamido)ethyl]-aniline (exemplified compound D-6) is particularly preferable.

These p-phenylenediamine derivatives may be in the form of salts such as sulfates, hydrochloride, sulfites, and p-toluenesulfonates. The amount of aromatic primary amine developing agent to be used is preferably about 0.1 g to about 20 g, more preferably about 0.5 g to about 10 g, per liter of developer.

In practicing the present invention, it is preferable to use a developer substantially free from benzyl alcohol Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same time have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0 \times 10^{-3}$ mol/l or below, and most preferably sulfite ions are not contained at all. However, in the present invention, a quite small amount of sulfite ions used for the prevention of oxidation of the processing kit in which the developing agent is condensed is not considered.

Preferably, the developer used in the present invention is substantially free from sulfite ions, and more preferably, in addition thereto it is substantially free from hydroxylamine. This is because hydroxylamine serves as a preservative of the developer, and at the same time has itself an activity for developing silver, and it is considered that the fluctuation of the concentration of hydroxylamine influences greatly the photographic characteristics. Herein the term "substantially free from hydroxylamine" means that preferably the concentration of hydroxylamine is $5.0 \times 10^{-3}$ mol/l or below, and most preferably hydroxylamine is not contained at all.

It is preferable that the developer used in the present invention contains an organic preservative instead of hydroxylamine or sulfite ions, in that process color-contamination and fluctuation of the photographic quality in continuous processing can be suppressed.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-aminoketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos. 4235/1988, 30845/1988, 21647/1988, 44655/1988, 5355/1988, 43140/1988, 56654/1988, 58346/1988, 43138/1988, 146041/1988, 170642/1988, 44657/1988, and 44656/1988, U.S. Pat. Nos. 3,615,503 and 2,494,903, JP-A No. 143020/1977, and JP-B 30496/1973.

As the other preservative, various metals described, for example, in JP-A Nos. 44148/1982 and 53749/1982, salicylic acids described, for example, in JP-A No. 180588/1984, alkanolamines described, for example, in JP-A No. 3532/1979, polyethyleneimines described, for example, in JP-A No. 94349/1981, aromatic polyhydroxyl compounds described, for example, in U.S. Pat. No. 3,746,544 may be included, if needed. It is particularly preferable the addition of alkanolamines such as triethanolamine, dialkylhydroxylamines such as diethylhydroxylamine, hydrazine derivatives, or aromatic polyhydroxyl compounds.

Of the above organic preservatives, hydroxylamine derivatives and hydrazine derivatives (i.e., hydrazines and hydrazides) are preferable and the details are described, for example, in Japanese Patent Application Nos. 255270/1987, 9713/1988, 9714/1988, and 11300/1988.

The use of amines in combination with the above-mentioned hydroxylamine derivatives or hydrazine derivatives is preferable in view of stability improvement of the color developer resulting its stability improvement during the continuous processing.

As the example of the above-mentioned amines cyclic amines described, for example, in JP-A No. 239447/1988, amines described, for example, in JP-A No. 128340/1988, and amines described, for example, in Japanese Patent Application Nos. 9713/1988 and 11300/1988.

In the present invention, it is preferable that the color developer contains chloride ions in an amount of $3.5\times10^{-2}$ to $1.5\times10^{-1}$ mol/l, more preferably $4\times10^{-2}$ to $1\times10^{-1}$ mol/l. If the concentration of ions exceeds $1.5\times10^{-1}$ mol/l, it is not preferably that the development is made disadvantageously slow, not leading to attainment of the objects of the present invention such as rapid processing and high density. On the other hand, if the concentration of chloride ions is less than $3.5\times10^{-2}$ mol/l, fogging is not prevented.

In the present invention, the color developer contains bromide ions preferably in an amount of $3.0\times10^{-5}$ to $1.0\times10^{-3}$ mol/l. More preferably bromide ions are contained in an amount $5.0\times10^{-5}$ to $5.0\times10^{-4}$ mol/l, most preferably $1.0\times10^{-4}$ to $3.0\times10^{-4}$ mol/l. If the concentration of bromide ions is more than $1.0\times10^{-3}$ mol/l, the development is made slow, the maximum density and the sensitivity are made low, and if the concentration of bromide ions is less than $3.0\times10^{-5}$ mol/l, fogging is not prevented sufficiently.

Herein, chloride ions and bromide ions may be added directly to the developer, or they may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred.

Chloride ions and bromide ions may be supplied from a brightening agent.

As the bromide ion-supplying material can be mentioned sodium bromide, potassium bromide, ammonium bromide, lithium bromide, calcium bromide, magnesium bromide, manganese bromide, nickel bromide, cadmium bromide, cerium bromide, and thallium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Preferably the color developer used in the present invention has a pH of 9 to 12, and more preferably 9 to 11.0, and it can contain other known developer components.

In order to keep the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino-2-methyl-1,3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH of 9.0 or higher, they do not adversely affect the photographic function (for example, to cause fogging), and they are inexpensive. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate). However, the present invention is not limited to these compounds.

The amount of buffer to be added to the color developer is preferably 0.1 mol/l, and particularly preferably 0.1 to 0.4 mol/l.

In addition to the color developer can be added various chelating agents to prevent calcium or magnesium from precipitating or to improve the stability of the color developer. As the example of chelating agents can be mentioned nitrilotriacetic acid, ethylenediaminetetraacetic acid, N,N,N-Nitrilo trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, glycol ether diaminetetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer.

As development accelerators, the following can be added as desired: thioether compounds disclosed, for example, in JP-B Nos. 16088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5 -nitroisoindazole, 5-methylbenzotriazole, 5-nitrobenzotriazole, 5-chloro-benzotriazole, 2-thiazolylbenzimidazole, 2-thiazolylmethyl-benzimidazole, indazole, hydroxyazaindolizine, and adenine.

It is preferable that the color developer used in the present invention contains a brightening agent. As a brightening agent, 4,4'-diamino-2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention is 20° to 50° C., and preferably 0° to 40° C. The processing time is 20 sec to 5 min, and preferably 30 sec to 2 min. Although it is preferable that the replenishing amount is as small as possible, it is suitable that the replenishing amount is 20 to 600 ml, preferably 50 to 300 ml, more preferably 60 to 200 ml, and most preferably 60 to 150 ml, per square meter of the photographic material.

The desilvering step in the present invention will now be described. Generally the desilvering step may comprise, for example, any of the following steps: a bleaching step—a fixing step; a fixing step—a bleach-fixing step; a bleaching step—a bleach-fixing step; and a bleach-fixing step.

Next, the bleaching solution, the bleach-fixing solution, and the fixing solution that are used in the present invention will be described.

As the bleaching agent used in the bleaching solution or the bleach-fixing solution used in present invention, use is made of any bleaching agents, but particularly it is preferable to use organic complex salts of iron(III) (e.g., complex salts of aminopolycarboxylic acids, such as ethylenediaminetetraacetic acid, and diethylenetriaminepentaacetic acid, aminopolyphosphonic acids, phosphonocarboxylic acids, and organic phosphonic acids); organic acids, such as citric acid, tartaric acid, and malic acid; persulfates; and hydrogen peroxide.

Of these, organic complex salts of iron(III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. These compounds may be in the form of any salts of sodium, potassium, lithium, or ammonium Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleaching solution, the bleach-fix solution, and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and *Research Disclosure* No. 17129 (July 1978), thiourea compounds described, for example, in JP-B No. 8506/1970, JP-A Nos. 20832/1977 and 32735/1978, and U.S. Pat. No. 3,706,561, or halides such as iodides and bromides, which are preferable because of their excellent bleaching power.

Further, the bleaching solution or the bleach-fixing solution used in the present invention can contain rehalogenizing agents, such as bromides (e.g., potassium bromide, sodium bromide, and ammonium bromide), chlorides (e.g., potassium chloride, sodium chloride, and ammonium chloride), or iodides (e.g., ammonium iodide). If necessary the bleaching solution or the bleach-fixing solution can contained, for example, one or more inorganic acids and organic acids or their alkali salts-or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 3 to 10, and particularly preferably 5 to 9.

Further, the bleach-fixing solution may additionally contain various brightening agents, anti-foaming agents, surface-active agents, polyvinyl pyrrolidone, and organic solvents, such as methanol.

The bleach-fixing solution or the fixing solution contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-foaming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television Engineers,* Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Horiguchi in *Bokin Bobai-zai no Kacaku* (1986) published by Sankyo-Shuppan, *Biseibutsu no Genkin, Sakkin, Bobai Gijutsu* (1982), edited by Eiseigijutsu-kai published by Kogyo-Gijutsu kai, and in *Bokin Bobai-zai Jiten* (1986) edited by Nihon Bokin Bobai-gakkai, can be used.

Further, the washing water can contain surface-active agents as a water draining agent, and chelating agents such as EDTA as a water softener.

After the washing step mentioned above, or without the washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 220345/1985, can be used.

Further, chelating agents, such as 1-hydroxyethylidene-1,1-diphosphonic acid, and ethylenediaminetetramethylenephosphonic acid, and magnesium and bismuth compounds can also be used in preferable modes.

A so-called rinse can also be used as a washing solution or a stabilizing solution, used after the desilverization.

The pH of the washing step or a stabilizing step is preferably 4 to 10, more preferably 5 to 8. The temperature will vary depending, for example, on the application and the characteristics of the photographic material, and it generally will be 15° to 45° C., and preferably 20° to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in the discharge and the handleability.

According to the present invention, a silver halide photographic material that is excellent in rapid processibility, high in sensitivity and contrast, less in the change of sensitivity due to a change of exposure illuminance, and less desensitized when pressure is applied to the emulsion grains can be obtained.

Next, the present invention will be described in more detail in accordance with examples, but the invention is not limited by them.

EXAMPLE 1

7.0 g of sodium chloride was added to a 3% aqueous solution of lime-treated gelatin, and then 3.2 ml of N,N'-dimethylimidazolidine-2-thione (1% aqueous solution) was added thereto. An aqueous solution containing 0.2 mol of silver nitrate and an aqueous solution containing 0.16 mol of potassium bromide and 0.04 mol of sodium chloride were added to and mixed with the gelatin solution at 60° C. with vigorous stirring. Then, an aqueous solution containing 0.8 mol of silver nitrate and an aqueous solution containing 0.64 mol of potassium bromide and 0.16 mol of sodium chloride were added to the above gelatin solution mixed with sodium chloride and mixed at 60° C. with vigorous stirring. After keeping the solution at 60° C. for 5 min, the temperature was lowered, and desalting and washing with water were effected. 90.0 g of lime-treated gelatin was added thereto, triethyl thiourea was added, and chemical sensitization was effected optimally. The obtained silver chlorobromide (silver bromide content: 80 mol %) emulsion was designated as emulsion A-1.

An emulsion that was designated as emulsion A-2 was prepared by the same procedure for the preparation of emulsion A-1, except that 9.66 μg and 38.65 μg of potassium hexachloroiridate (IV) were added respectively to the first and second aqueous alkali halide solutions.

3.3 g of sodium chloride was added to a 3% aqueous solution of lime-treated gelatin, and then 3.2 ml of N,N'-dimethylimidazolidine-2-thione (1% aqueous solution) was added thereto. An aqueous solution containing 0.2 mol of silver nitrate and an aqueous solution containing 0.2 mol of sodium chloride were added to and mixed with the resulting solution at 52° C. with vigorous stirring. Then, an aqueous solution containing 0.8 mol of silver nitrate and an aqueous solution containing 0.8 mol of sodium chloride were added to and mixed with the solution at 52° C. with vigorous stirring. After keeping the solution at 52° C. for 5 min, the temperature was lowered, and desalting and washing with water were effected. 90.0 g of lime-treated gelatin was added thereto, triethyl thiourea was added, and chemical sensitization was effected optimally. The obtained silver chloride emulsion was designated as emulsion B-1.

An emulsion that was designated as emulsion B-2 was prepared by the same procedure for the preparation of emulsion B-1, except that 0.84 mg and 3.38 mg of potassium hexacyanoferrate (II) trihydrate were added respectively to the first and second aqueous sodium chloride solutions.

An emulsion that was designated as emulsion B-3 was prepared by the same procedure for the preparation of emulsion B-1, except that 4.22 mg potassium hexacyanoferrate (II) trihydrate was added to the second aqueous sodium chloride solution.

An emulsion that was designated as emulsion B-4 was prepared by the same procedure for the preparation of emulsion B-1, except that the second aqueous silver nitrate solution and the second aqueous sodium chloride solution each were divided into 3:5 and added sequently, so that the addition of the silver nitrate/sodium chloride might be carried out three times in all, and 4.22 mg of potassium hexacyanoferrate (II) trihydrate was added to the third aqueous sodium chloride solution.

Emulsion B-5 was prepared by the same procedure for the preparation of emulsion B-4, except that the ratio of the second aqueous silver nitrate solution to the third and the ratio of the second aqueous sodium chloride solution to the third were changed to 1:1.

Emulsion B-6 was prepared by the same procedure for the preparation of emulsion B-4, except that the ratio of the second aqueous silver nitrate solution to the third and the ratio of the second aqueous sodium chloride solution to the third were changed to 3:1.

Emulsion B-7 was prepared by the same procedure for the preparation of emulsion B-4, except that the ratio of the second aqueous silver nitrate solution to the third and the ratio of the second aqueous sodium chloride solution to the third were changed to 7:1.

An emulsion that was designated as emulsion B-8 was prepared by the same procedure for the preparation of emulsion B-1, except that 9.66 μg and 38.65 μg of potassium hexachloroiridate (IV) were added to the first and second aqueous sodium chloride solutions respectively.

Emulsions that were designated as emulsion B-9 to B-14 were prepared by the same procedures for the preparation of emulsions B-2 to B-7, except that 48.31 μg potassium hexachloroiridate (IV) was added simultaneously with the potassium hexacyanoferrate (II) trihyrate to the aqueous sodium chloride solution.

An emulsion that was designated as emulsion B-15 was prepared by the same procedure for the preparation of emulsion B-7 was repeated, except that 10.74 μg and 37.57 μg of potassium hexachloroiridate (IV) were added to the first and second aqueous sodium chloride solutions respectively.

An emulsion that was designated as emulsion B-16 was prepared by the same procedure for the preparation of emulsion B-7 was repeated, except that 5.37 μg, 18.79 μg, and 24.15 μg of potassium hexachloroiridate (IV) were added to the first, second, and third aqueous sodium chloride solutions respectively.

All of the silver halide grains contained in these 18 emulsions prepared as described were approximately identical cubes having an average side length of 0.5 μm, and the deviation coefficient of the grain size was 0.08.

The halogen compositions and the parts containing iron ions and iridium ions in the grains of these emulsions are summarized in Table 1.

Then, 38.0 g of cyan coupler (a), 17.0 g of image-dye stabilizer (b), and 35.0 g of image-dye stabilizer (c) were dissolved in 40.0 ml of ethyl acetate and 23.0 g of solvent (d), and the obtained solution was emulsified and dispersed into 400 ml of a 10% aqueous gelatin solution containing 10% sodium dodecylbenzenesulfonate.

Spectrally sensitizing dyes (e) and (f) were added to each of the silver halide emulsions prepared above in amounts of $5.0\times10^{-5}$ mol/mol Ag and $1.0\times10^{-3}$ mol/mol Ag respectively, to prepare red-sensitive emulsions, and the above emulsified dispersion of the coupler was mixed with each of the red-sensitive emulsions, to prepare coating solutions that would have the compositions shown in Table 2. Each of the coating solutions was applied to paper bases, the both surfaces of which were laminated with polyethylene, with the layer constitution shown in Table 2, thereby preparing 18 photographic materials. As a gelatin hardener for each layer, 1-oxy-3,5-dichloro s-triazine sodium salt was used.

TABLE 1

| Emulsion | Halogen Composition (mol %) | Fe (II) Ions (mol/mol · Ag) | Fe Ions-containing Layer in Grain | Ir (IV) Ions (mol/mol · Ag) | Ir ions-containing Layer in Grain |
|---|---|---|---|---|---|
| A-1 | Cl:20 (Br:80) | 0 | — | 0 | — |
| A-2 | Cl:20 (Br:80) | 0 | — | $1\times10^{-7}$ | Uniformly in whole grain |
| B-1 | Cl:100 | 0 | — | 0 | — |
| B-2 | Cl:100 | $1\times10^{-5}$ | Uniformly in whole grain[1)] | 0 | — |
| B-3 | Cl:100 | $1\times10^{-5}$ | 80% of surface layer[2)] | 0 | — |

TABLE 1-continued

| Emulsion | Halogen Composition (mol %) | Fe (II) Ions (mol/mol · Ag) | Fe Ions-containing Layer in Grain | Ir (IV) Ions (mol/mol · Ag) | Ir ions-containing Layer in Grain |
|---|---|---|---|---|---|
| B-4 | Cl:100 | $1 \times 10^{-5}$ | 50% of surface layer | 0 | — |
| B-5 | Cl:100 | $1 \times 10^{-5}$ | 40% of surface layer | 0 | — |
| B-6 | Cl:100 | $1 \times 10^{-5}$ | 20% of surface layer | 0 | — |
| B-7 | Cl:100 | $1 \times 10^{-5}$ | 10% of surface layer | 0 | — |
| B-8 | Cl:100 | 0 | — | $1 \times 10^{-7}$ | Uniformly in whole grain |
| B-9 | Cl:100 | $1 \times 10^{-5}$ | Uniformly in whole grain | $1 \times 10^{-7}$ | Uniformly in whole grain |
| B-10 | Cl:100 | $1 \times 10^{-5}$ | 80% of surface layer | $1 \times 10^{-7}$ | 80% of surface layer |
| B-11 | Cl:100 | $1 \times 10^{-5}$ | 50% of surface layer | $1 \times 10^{-7}$ | 50% of surface layer |
| B-12 | Cl:100 | $1 \times 10^{-5}$ | 40% of surface layer | $1 \times 10^{-7}$ | 40% of surface layer |
| B-13 | Cl:100 | $1 \times 10^{-5}$ | 20% of surface layer | $1 \times 10^{-7}$ | 20% of surface layer |
| B-14 | Cl:100 | $1 \times 10^{-5}$ | 10% of surface layer | $1 \times 10^{-7}$ | 10% of surface layer |
| B-15 | Cl:100 | $1 \times 10^{-5}$ | 10% of surface layer | $1 \times 10^{-7}$ | Uniformly in whole grain |
| B-16 | Cl:100 | $1 \times 10^{-5}$ | 10% of surface layer | $1 \times 10^{-7}$ | Core and 10% of surface layer |

Note:
1)Fe ions were distributed uniformly in the grain.
2)Fe ions were distributed in the outer layer which is 80% by volume of the grain volume.

TABLE 2

| | |
|---|---|
| Second layer (Protective layer) | |
| Gelatin | 1.50 g/m² |
| First layer (Red-sensitive emulsion layer) | |
| Silver chloride (chlorobromide) emulsion (A-1, A-2, and B-1 to B-16) silver | 0.24 g/m² |
| Cyan coupler (a) | 0.38 g/m² |
| Image-dye stabilizer (b) | 0.17 g/m² |
| Image-dye stabilizer (c) | 0.35 g/m² |
| Solvent (d) | 0.23 ml/m² |
| Gelatin | 1.00 g/m² |
| Substrate | |
| Both sides polyethylene laminated paper base ($TiO_2$ and marine blue were contained in the first layer side polyethylene film.) | |

Compounds used are as follows:

(a) Cyan coupler

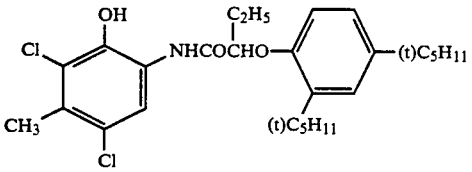

(b) Image-dye stabilizer
(Mixture in molar ratio of 1;3;3)

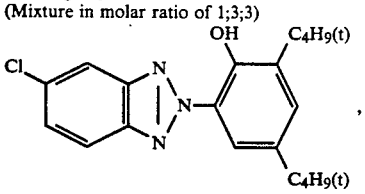

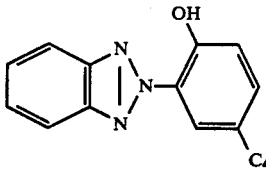

, and

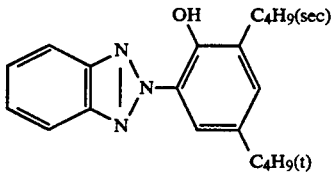

-continued (c) Image-dye stabilizer

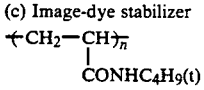

Molecular weight (number average): 60,000

(d) Solvent

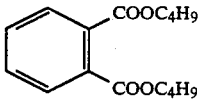

(e) Spectral sensitizing dye

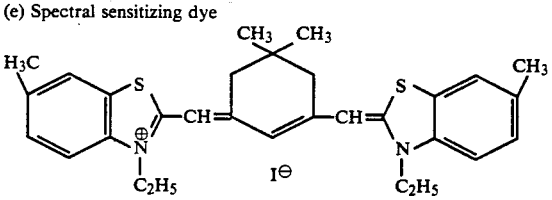

(f)

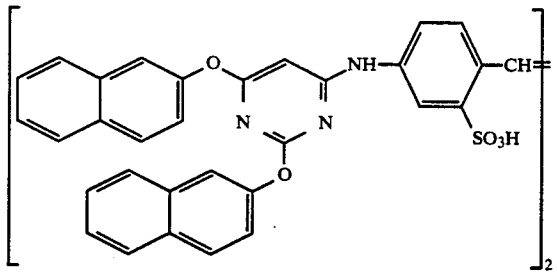

Using the thus obtained 18 coated samples (named the same as the emulsions used), the performance of the emulsion was tested.

Immediately after the samples were exposed through an optical wedge and a red filter to light of 250 CMS at room temperature (24° C.) for 0.1 sec, they were subjected to color development processing using the developing steps and the developing solution shown below. At that time, in order to assess the rapid processibility, two development times: 20 sec and 45 sec, were employed for comparison.

Then, to check the change of sensitivity of the samples when the exposure illuminance is changed, exposure of 250 CMS for 0.01 sec was also carried out and development was effected.

Further, to check the change of development density with the lapse of time after the exposure of the samples, experiments were carried out wherein development was carried out two hours after exposure of 250 CMS for 0.1 sec.

The reflection density of each of the thus prepared processed samples was measured to obtain so-called characteristic curves. The reciprocal of the exposure amount that gave a density 0.5 higher than the fogging density was assumed the sensitivity, which was indicated in terms of a relative value with the sensitivity of sample A-1 of exposure of 0.1 sec at room temperature assumed to be 100.

The density corresponding to the exposure amount that was increased by 0.6 in terms of log E from the exposure amount for which the sensitivity was determined was obtained and assumed to be its contrast.

The change of development density with the lapse of time after exposure was judged from the value obtained in such a manner that the exposure amount that gave a density of 0.6 in the sample processed immediately after exposure was determined, and 0.6 was subtracted from the color density corresponding to that exposure amount in the sample processed two hours after exposure.

To check the change when pressure is applied to the photographic materials, before exposure the samples were scratched at a speed of 5 cm/sec using sapphire needles (whose tip had a curvature radius of 0.03 mm) under each load of 2 g, 4 g, 6 g, and 8 g, and then the samples were exposed to light, developed, and checked for desensitization. The results were judged as follows.

Criterion of desensitization degree xx: recognized desensitization from load of 2 g
x: recognized desensitization from load of 4 g
Δ: recognized desensitization from load of 6 g
: recognized desensitization under load of 8 g
◎: not recognized desensitization under load of 8 g Results are shown in Table 3.

-continued

| Processing step | Temperature | Time |
|---|---|---|
| Rinsing (3) | 30–35° C. | 20 sec. |
| Rinsing (4) | 30–35° C. | 30 sec. |
| Drying | 70–80° C. | 60 sec. |

Note:
Rinsing steps were carried out in 4-tanks counter-current mode from the tank of rinsing (4) towards the tank of rinsing (1).

Composition of each processing solution are as follows:

| | |
|---|---|
| Color developer | |
| Water | 1000 ml |
| Ethylenediamine-N,N,N',N'-tetramethylene phosphonic acid | 1.5 g |
| Triethylenediamine(1,4-diazabicyclo-[2,2,2]octane | 5.0 g |
| Sodium chloride | 1.4 g |
| Potassium carbonate | 25.0 g |
| N-ethyl-N-(β-methanesulfonamidoethyl)-3-methyl-4-aminoaniline sulfate | 5.0 g |
| N,N-diethylhydroxylamine | 4.2 g |
| Fluorescent brightening agent (UVITEX CK, made by Ciba Gaigy) | 2.0 g |
| Water to make | 1000 ml |
| ph (25° C.) | 10.10 |
| Bleach-fixing solution | |
| Water | 400 ml |
| Ammonium thiosulfate (70%) | 100 ml |
| Sodium sulfite | 18.0 g |
| Iron (III) ammonium ethylenediamine-tetraacatate | 55.0 g |
| Disodium ethylenediaminetetraacetate | 3.0 g |
| Ammonium bromide | 40.0 g |
| Water to make | 1000 ml |
| ph (25° C.) | 5.50 |

Rinsing solution

Ion-exchanged water (each content of calcium and magnesium was 3 ppm)

TABLE 3

| Sample | 0.1 sec. Exposure to Light: 20 sec. S* | Development Contrast | 45 sec. S* | Development Contrast | 0.01 sec. Exposure: 5 sec. S* | Development Contrast | Increment of Density** | Decrement of Sensitivity due to Pressure | Remarks |
|---|---|---|---|---|---|---|---|---|---|
| A-1 | 26 | 0.71 | 100 | 0.99 | 64 | 0.80 | +0.01 | ◎ | Comparative Example |
| A-2 | 19 | 1.02 | 72 | 1.11 | 70 | 1.09 | +0.02 | ◎ | Comparative Example |
| B-1 | 32 | 1.79 | 47 | 1.85 | 29 | 1.52 | +0.02 | ◎ | Comparative Example |
| B-2 | 45 | 1.86 | 66 | 1.94 | 48 | 1.67 | +0.01 | X | Comparative Example |
| B-3 | 51 | 1.91 | 77 | 2.03 | 62 | 1.75 | +0.03 | X | Comparative Example |
| B-4 | 76 | 2.14 | 108 | 2.28 | 89 | 1.93 | +0.02 | Δ-○ | Comparative Example |
| B-5 | 97 | 2.20 | 133 | 2.33 | 104 | 1.99 | +0.01 | ○ | Comparative Example |
| B-6 | 114 | 2.27 | 154 | 2.39 | 125 | 2.07 | +0.02 | ○ | Comparative Example |
| B-7 | 128 | 2.29 | 159 | 2.41 | 138 | 2.12 | +0.02 | ◎ | Comparative Example |
| B-8 | 24 | 2.28 | 35 | 2.36 | 33 | 2.31 | +0.49 | ◎ | Comparative Example |
| B-9 | 41 | 1.98 | 56 | 2.07 | 52 | 1.91 | +0.43 | X | Comparative Example |
| B-10 | 46 | 2.04 | 68 | 2.15 | 63 | 1.99 | +0.37 | X | Comparative Example |
| B-11 | 73 | 2.26 | 102 | 2.39 | 101 | 2.35 | +0.07 | Δ-○ | This Invention |
| B-12 | 96 | 2.32 | 130 | 2.45 | 127 | 2.42 | +0.05 | ○ | This Invention |
| B-13 | 113 | 2.36 | 151 | 2.49 | 149 | 2.46 | +0.05 | ○ | This Invention |
| B-14 | 127 | 2.41 | 157 | 2.52 | 154 | 2.50 | +0.03 | ◎ | This Invention |
| B-15 | 110 | 2.39 | 135 | 2.50 | 133 | 2.48 | +0.39 | ◎ | Comparative Example |
| B-16 | 113 | 2.38 | 139 | 2.51 | 137 | 2.49 | +0.29 | ◎ | Comparative Example |

Note:
*Sensitivity
**Increment of density for 2 hours between an exposure to light and development processing

| Processing step | Temperature | Time |
|---|---|---|
| Color developing | 35° C. | 20 sec., 45 sec. |
| Bleach-fixing | 35° C. | 45 sec. |
| Rinsing (1) | 30–35° C. | 20 sec. |
| Rinsing (2) | 30–35° C. | 20 sec. |

From the results, the remarkable effect of the present invention can be noted. That is, as can be understood by comparing sample A-1 and sample A-2, if an emulsion having a silver bromide content of 80 mol % is used, the change of sensitivity and contrast at the time when the illuminance of exposure is changed can be improved by incorporating iridium ions in silver halide grains without causing such impairment as latent image sensitization, but since the development is slow and the contrast is conspicuously low within the tested processing time, the emulsion cannot be of practical use.

In contrast, in sample B-1, which uses an emulsion having a silver chloride content of 100 mol %, although the developing speed becomes remarkably fast and high contrast can be secured even when rapid processing is used, the sensitization is low, and therefore it is not practical. Further, at high-illuminance exposure the sensitivity and contrast lower conspicuously.

In sample B-9, which uses an emulsion obtained by containing only iridium ions in a silver chloride emulsion, although very high contrast can be obtained even when it is exposed at high illuminance, the sensitivity lowers and remarkable latent-image sensitization occurs, which makes it unacceptable for practical use.

On the other hand, when iron ions are contained in a silver chloride emulsion, an increase in sensitivity is observed and the sensitivity change due to a change in illuminance at the time of exposure can be reduced. This effect is noted more remarkably in the case that uses emulsions wherein iron ions are concentrated on the grain surface. Further, by making iron ions concentrated on the grain surface, desensitization due to the application of pressure can be decreased effectively.

However, in samples B-2 to B-7, which use emulsions containing iron ions alone, contrast, particularly at the shoulder at high-illuminance exposure, is not adequate.

Only when emulsions in which iron ions and iridium ions are concentrated together on the surface layer, photographic materials excellent in rapid processibility, high in sensitivity and contrast, and also high in contrast of the shoulder at high-illuminance exposure can be obtained without causing such impairment as latent-image sensitization.

The above effect of the present invention is a new finding not known previously.

EXAMPLE 2

6.4 g of sodium chloride was added to a 3% aqueous solution of lime-treated gelatin, and then 4.2 ml of N,N'-dimethylimidazolidine-2-thione (1% aqueous solution) was added thereto. An aqueous solution containing 0.2 mol of silver nitrate and an aqueous solution containing 0.16 mol of potassium bromide and 0.04 mol of sodium chloride were added to and mixed with the resulting solution at 72° C. with vigorous stirring. Then, an aqueous solution containing 0.8 mol of silver nitrate and an aqueous solution containing 0.64 mol of potassium bromide and 0.16 mol of sodium chloride were added to and mixed with the solution at 72° C. with vigorous stirring. After keeping the solution at 72° C. for 5 min, the temperature was lowered, and desalting and washing with water were effected. Then 90.0 g of lime-treated gelatin was added thereto, and after adjusting the pH and pAg, spectrally sensitizing dye (g), described later, in an amount of $3.0\times10^{-4}$ mol per mol of the silver halide and triethyl thiourea in an amount of $1.0\times10^{-5}$ mol per mol of the silver halide were added, to effect spectral sensitization and chemical sensitization. The obtained silver chlorobromide (having a silver bromide content of 80 mol %) emulsion was designated as emulsion B-201.

Next, 3.3 g of sodium chloride was added to a 3 aqueous solution of lime treated gelatin, and then 3.2 ml of N,N'-dimethylimidazolidine-2-thione (1% aqueous solution) was added thereto. An aqueous solution containing 0.2 mol of silver nitrate and an aqueous solution containing 0.004 mol of potassium bromide and 0.196 mol of sodium chloride were added to and mixed with the resulting solution at 66° C. with vigorous stirring. Then, an aqueous solution containing 0.8 mol of silver nitrate and an aqueous solution containing 0.016 mol of potassium bromide and 0.784 mol of sodium chloride were added to and mixed with the solution at 66° C. with vigorous stirring. After keeping the solution at 66° C. for 5 min, the temperature was lowered, and desalting and washing with water were effected. 90.0 g of lime-treated gelatin was added thereto, then the pH and pAg were adjusted, and spectrally sensitizing dye (g) and triethyl thiourea were added, as with emulsion B-201, to effect spectral sensitization and chemical sensitization. The obtained silver chlorobromide (silver bromide content: 80 mol %) emulsion was designated as emulsion B-202.

An emulsion that was designated as emulsion B-203 was prepared by the same procedure for the preparation of Emulsion B-202, except that 0.42 mg and 1.69 mg of potassium hexacyanoferrate (II) trihydrate were added respectively to the first and second aqueous alkali halide solutions.

An emulsion that was designated as emulsion B-204 was prepared by the same procedure for the preparation of emulsion B-202, except that the second aqueous silver nitrate solution and the second aqueous alkali halide solution were divided to 7:1 and added sequently to effect the addition of silver nitrate/alkali halide three times in all, and 0.234 mg, 0.821 mg, and 1.055 mg of potassium hexacyanoferrate (II) trihydrate were added to the first, second and third aqueous alkali halide solutions respectively. In the preparation of the emulsion grains, the supply of the reaction solution was divided into three. When the outermost surface layer, which is high in iron ion concentration, and the core part inside the outermost surface layer are considered separately, the surface layer ratio of the emulsion grains is 10%, and the iron ion concentration of the surface layer is 9.0 times that of the grain core part.

An emulsion that was designated as emulsion B-205 was prepared by the same procedure for the preparation of emulsion B-202, except that the second aqueous silver nitrate solution and the second aqueous alkali halide solution were divided and added sequently 7:1 to effect the addition of silver nitrate/alkali halide three times in all, and 2.11 mg of potassium hexacyanoferrate (II) trihydrate added to the third aqueous alkali halide solution.

3.3 g of sodium chloride was added to a 3% aqueous solution of lime-treated gelatin, and then 3.2 ml of N,N'-dimethylimidazolidine-2-thione (1% aqueous solution) was added thereto. An aqueous solution containing 0.2 mol of silver nitrate and an aqueous solution containing 0.2 mol of sodium chloride were added to and mixed with the resulting solution at 66° C. with vigorous stirring. Then, an aqueous solution containing 0.7 mol of silver nitrate and an aqueous solution containing 0.7 mol of sodium chloride were added to and mixed with the solution at 66° C. with vigorous stirring. Further, an aqueous solution containing 0.1 mol of silver nitrate and an aqueous solution containing 2.11 mg of potassium hexacyanoferrate (II) trihydrate and 0.1 mol of sodium chloride were added to and mixed with the solution at 66° C. with vigorous stirring. After keeping the solution at 66° C. for 5 min, the temperature was lowered, desalting and washing with water were effected. Further, 90.0 g of lime-treated gelatin was added thereto, and after the pH and the pAg were adjusted, spectrally sensitizing dye (g), a silver bromide fine-grain emulsion (having an average particle size of 0.05 μm) corresponding to 2 mol % for the silver halide, and ethyl thiourea were added, to effect spectral sensitization and chemical sensitization. The resulting emulsion was designated as emulsion B-206.

Next, 3.3 g of sodium chloride was added to a 3 aqueous solution of lime-treated gelatin, and then 3.2 ml of N,N'-dimethylimidazolidine-2-thione (1% aqueous solution) was added thereto. An aqueous solution containing 0.2 mol of silver nitrate and an aqueous solution containing 0.2 mol of sodium chloride were added to and mixed with the resulting solution at 66° C. with vigorous stirring. Then, an aqueous solution containing 0.8 mol of silver nitrate and an aqueous solution containing 0.8 mol of sodium chloride were added to and mixed with the solution at 66° C. with vigorous stirring. After keeping the solution at 66° C. for 5 min, the temperature was lowered, and desalting and washing with water were effected. Further, 90.0 g of lime-treated gelatin was added thereto, then after the pH and the pAg were adjusted, spectrally sensitizing dye (g) and triethyl thiourea were added, to effect spectral sensitization and chemical sensitization. The obtained silver chloride emulsion was designated as emulsion B-207.

An emulsion that was designated as emulsion B-208 was prepared by the same procedure for the preparation of emulsion B-207, except that 0.42 mg and 1.69 mg of potassium hexacyanoferrate (II) trihydrate were added to the first and second aqueous sodium chloride solutions respectively.

An emulsion that was designated as emulsion B-209 was prepared by the same procedure for the preparation of emulsion B-207, except that the second aqueous silver nitrate solution and the second aqueous sodium chloride solution were divided to 7:1 and added sequently to effect the addition of silver nitrate/sodium chloride three times in all, and 0.234 mg, 0.821 mg, and 1.055 mg of potassium hexacyanoferrate (II) trihydrate were added to the first, second, and third aqueous sodium chloride solutions respectively. In the preparation of the emulsion grains, the supply of the reaction solution was divided into three. When the outermost surface layer, which is high in iron ion concentration, and the core part inside the outermost surface layer are considered separately, the surface layer ratio of the emulsion grains is 10%, and the iron ion concentration of the surface layer is 9.0 times that of the grain core part.

Next, an emulsion that was designated as emulsion B-210 was prepared by the same procedure for the preparation of emulsion B-209, except that 2.11 mg of potassium hexacyanoferrate (II) trihydrate was added to the third aqueous sodium chloride solution.

Next, an emulsion that was designated as emulsion B-211 was prepared by the same procedure for the preparation of emulsion B-201, except that 4.83 μg and 19.33 μg of potassium hexachloroiridate (IV) were added to the first and second aqueous alkali halide solutions respectively.

Next, emulsions that were designated as emulsions B-212 and B 213 were prepared by the same procedures for the preparation of emulsions B-202 and B-203, except that 4.83 μg and 19.33 μg of potassium hexachloroiridate (IV) were added to the first and second aqueous alkali halide solutions respectively.

Next, an emulsion that was designated as emulsion B-214 was prepared by the same procedure for the preparation of emulsion B-204, except that 24.16 μg of potassium hexachloroiridate (IV) was added to the third aqueous alkali halide solution.

Next, an emulsion that was designated as emulsion B-215 was prepared by the same procedure for the preparation of emulsion B-205, except that 5.37 μg and 18.79 μg of potassium hexachloroiridate (IV) were added to the first and second aqueous alkali halide solutions respectively.

Next, an emulsion that was designated as emulsion B-216 was prepared by the same procedure for the preparation of emulsion B-205, except that 4.83 μg, 16.91 μg, and 2.42 μg of potassium hexachloroiridate (IV) were added to the first, second and third aqueous alkali halide solutions respectively.

Next, an emulsion that was designated as emulsion B-217 was prepared by the same procedure for the preparation of Emulsion B-205, except that 24.16 μg of potassium hexachloroiridate (IV) was added to the third aqueous alkali halide solution.

Next, an emulsion that was designated as emulsion B-218 was prepared by the same procedure for the preparation of emulsion B-206, except that 24.16 μg of potassium hexachloroiridate (IV) was added to the third aqueous alkali halide solution.

Next, emulsions that were designated as emulsions B-219 and B-220 were prepared by the same procedures for the preparation of emulsions B-207 and B-208, except that 4.83 μg and 19.33 μg of potassium hexachloroiridate (IV) were added to the first and second aqueous alkali halide solutions respectively.

Next, emulsions that were designated as emulsions B-221 and B-222 were prepared by the same procedures for the preparation of emulsions B-209 and B-210 were repeated, except that 24.16 μg of potassium hexachloroiridate (IV) was added to the third aqueous alkali halide solution.

In the methods for the preparation of these emulsions, by changing the temperature at which silver halide emulsion grains were formed and by altering the speed of the addition of the reaction solutions, to prepare emulsions having an average grain size of about 0.46 μm, by changing the spectrally sensitizing dye to (h), mentioned later, and by doubling the amounts of potassium hexacyanoferrate (II) trihydrate and potassium hexacycloiridate (IV), emulsions G-201 to G-222 were prepared.

In the methods for the preparation of emulsions G-201 to G-212, by changing the temperature at which silver halide emulsion grains were formed and by altering the speed of the addition of the reaction solutions, to prepare emulsions having an average grain size of about 0.53 μm, and by changing spectrally sensitizing dye to (e) and (f), emulsions R-201 to R-222 were prepared.

The halogen compositions and the grain sizes of these emulsions and the parts containing iron ions in the grains are summarized in Table 4-1 to 4-3. When, out of these, emulsions B-206, B-218, G-206, G-218, R-206, and R-218 were subjected to halogen composition analysis by the X-ray diffraction method, it was observed that, in addition to the main peak indicating 100 mol % of silver chloride, there was a subsidiary peak corresponding to a silver bromide content of 30 to 40%, so that it was found that these emulsion grains had silver bromide localized phases.

By using the thus prepared emulsions for multilayers, 22 color photographic materials were prepared; their compositions, layer constitutions, and the combinations of the emulsions are shown in Tables 5 and 6. The coating solutions were prepared as shown below.

First layer coating solution 27.2 ml of ethyl acetate and 7.9 ml of Solvent (d) were added to 19.1 g of Yellow Coupler (i), 4.4 g of Image Dye Stabilizer (j), and 0.7 g of Image Dye Stabilizer, to dissolve them, and the solution was emulsified and dispersed into 200 ml of a 10% aqueous gelatin solution containing 8.0 ml of 10% sodium dodecylbenzenesulfonate.

The thus obtained emulsified dispersion of the coupler and each of the silver halide emulsions shown in Table 6 were mixed and dissolved, to prepare first layer coating solutions having the compositions shown in Table 5.

Coating solutions of second to seventh layers were prepared in a similar manner to the first coating solutions, but with respect to the emulsified dispersions used in the fifth layer coating solutions, after emulsification and dispersion the ethyl acetate was distilled off under reduced pressure at 40° C.

As a gelatin hardener for each layer the same compound used in Example 1 was employed.

Compounds used are as follows:
(a) to (f) are the same as in Example 1.

(g) Spectral sensitizing dye

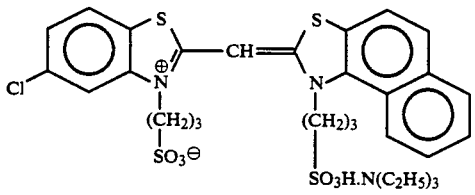

(h) Spectral sensitizing dye

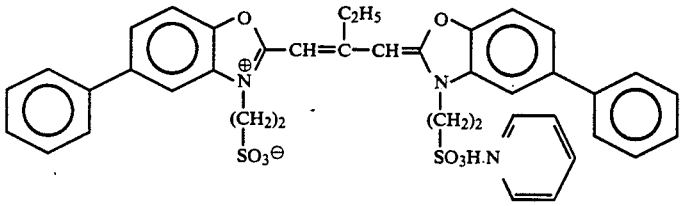

TABLE 4-1

| Emulsion | Halide Composition (mol %) | Particle Size (μm) | Particle Distribution Coefficient | AgBr Localized Phase | Fe (II) Ions (mol/mol · Ag) |
|---|---|---|---|---|---|
| B 201 | Cl:20(Br:80) | 0.98 | (0.09) | Absent | 0 |
| B 202 | Cl:98(Br:2) | 0.97 | (0.08) | Absent | 0 |
| B 203 | Cl:98(Br:2) | 0.97 | (0.08) | Absent | $5 \times 10^{-6}$ |
| B 204 | Cl:98(Br:2) | 0.97 | (0.08) | Absent | $5 \times 10^{-6}$ |
| B 205 | Cl:98(Br:2) | 0.97 | (0.08) | Absent | $5 \times 10^{-6}$ |
| B 206 | Cl:98(Br:2) | 0.97 | (0.08) | Present | $5 \times 10^{-6}$ |
| B 207 | Cl:100 | 0.96 | (0.07) | Absent | 0 |
| B 208 | Cl:100 | 0.96 | (0.07) | Absent | $5 \times 10^{-6}$ |
| B 209 | Cl:100 | 0.96 | (0.07) | Absent | $5 \times 10^{-6}$ |
| B 210 | Cl:100 | 0.96 | (0.07) | Absent | $5 \times 10^{-6}$ |
| B 211 | Cl:20(Br:80) | 0.98 | (0.09) | Absent | 0 |
| B 212 | Cl:98(Br:2) | 0.97 | (0.08) | Absent | 0 |
| B 213 | Cl:98(Br:2) | 0.97 | (0.08) | Absent | $5 \times 10^{-6}$ |
| B 214 | Cl:98(Br:2) | 0.97 | (0.08) | Absent | $5 \times 10^{-6}$ |
| B 215 | Cl:98(Br:2) | 0.97 | (0.08) | Absent | $5 \times 10^{-6}$ |
| B 216 | Cl:98(Br:2) | 0.97 | (0.08) | Absent | $5 \times 10^{-6}$ |
| B 217 | Cl:98(Br:2) | 0.97 | (0.08) | Absent | $5 \times 10^{-6}$ |
| B 218 | Cl:98(Br:2) | 0.97 | (0.08) | Present | $5 \times 10^{-6}$ |
| B 219 | Cl:100 | 0.96 | (0.07) | Absent | 0 |
| B 220 | Cl:100 | 0.96 | (0.07) | Absent | $5 \times 10^{-6}$ |
| B 221 | Cl:100 | 0.96 | (0.07) | Absent | $5 \times 10^{-6}$ |
| B 222 | Cl:100 | 0.96 | (0.07) | Absent | $5 \times 10^{-6}$ |

| Emulsion | Fe Ions-containing Layer in Grain | Ir (IV) Ions (mol/mol · Ag) | Ir Ions-containing Layer in Grain | Spectral Sensitizing Dye | Spectral Sensitizing (mol/mol · Ag) |
|---|---|---|---|---|---|
| B 201 | Absent | 0 | Absent | (g) | $(3 \times 10^{-4})$ |
| B 202 | Absent | 0 | Absent | (g) | $(3 \times 10^{-4})$ |
| B 203 | Uniformly in whole grain | 0 | Absent | (g) | $(3 \times 10^{-4})$ |
| B 204 | Core and 10% of surface | 0 | Absent | (g) | $(3 \times 10^{-4})$ |
| B 205 | 10% of surface | 0 | Absent | (g) | $(3 \times 10^{-4})$ |
| B 206 | 10% of surface | 0 | Absent | (g) | $(3 \times 10^{-4})$ |

TABLE 4-1-continued

| | | | | | |
|---|---|---|---|---|---|
| B 207 | Absent | 0 | Absent | (g) | $(3 \times 10^{-4})$ |
| B 208 | Uniformly in whole grain | 0 | Absent | (g) | $(3 \times 10^{-4})$ |
| B 209 | Core and 10% of surface | 0 | Absent | (g) | $(3 \times 10^{-4})$ |
| B 210 | 10% of surface | 0 | Absent | (g) | $(3 \times 10^{-4})$ |
| B 211 | Absent | $5 \times 10^{-8}$ | Uniformly in whole grain | (g) | $(3 \times 10^{-4})$ |
| B 212 | Absent | $5 \times 10^{-8}$ | Uniformly in whole grain | (g) | $(3 \times 10^{-4})$ |
| B 213 | Uniformly in whole grain | $5 \times 10^{-8}$ | Uniformly in whole grain | (g) | $(3 \times 10^{-4})$ |
| B 214 | Core and 10% of surface | $5 \times 10^{-8}$ | 10% of surface | (g) | $(3 \times 10^{-4})$ |
| B 215 | 10% of surface | $5 \times 10^{-8}$ | 90% of core of grain | (g) | $(3 \times 10^{-4})$ |
| B 216 | 10% of surface | $5 \times 10^{-8}$ | Uniformly in whole grain | (g) | $(3 \times 10^{-4})$ |
| B 217 | 10% of surface | $5 \times 10^{-8}$ | 10% of surface | (g) | $(3 \times 10^{-4})$ |
| B 218 | 10% of surface | $5 \times 10^{-8}$ | 10% of surface | (g) | $(3 \times 10^{-4})$ |
| B 219 | Absent | $5 \times 10^{-8}$ | Uniformly in whole grain | (g) | $(3 \times 10^{-4})$ |
| B 220 | Uniformly in whole grain | $5 \times 10^{-8}$ | Uniformly in whole grain | (g) | $(3 \times 10^{-4})$ |
| B 221 | Core and 10% of surface | $5 \times 10^{-8}$ | 10% of surface | (g) | $(3 \times 10^{-4})$ |
| B 222 | 10% of surface | $5 \times 10^{-8}$ | 10% of surface | (g) | $(3 \times 10^{-4})$ |

Note: All silver halide grains are cubic in shape.

TABLE 4-2

| Emulsion | Halide Composition (mol %) | Particle Size (μm) | Particle Distribution Coefficient | AgBr Localized Phase | Fe (II) Ions (mol/mol · Ag) |
|---|---|---|---|---|---|
| G 201 | Cl:20(Br:80) | 0.46 | (0.08) | Absent | 0 |
| G 202 | Cl:98(Br:2) | 0.45 | (0.07) | Absent | 0 |
| G 203 | Cl:98(Br:2) | 0.45 | (0.07) | Absent | $1 \times 10^{-5}$ |
| G 204 | Cl:98(Br:2) | 0.45 | (0.07) | Absent | $1 \times 10^{-5}$ |
| G 205 | Cl:98(Br:2) | 0.45 | (0.07) | Absent | $1 \times 10^{-5}$ |
| G 206 | Cl:98(Br:2) | 0.45 | (0.07) | Present | $1 \times 10^{-5}$ |
| G 207 | Cl:100 | 0.46 | (0.07) | Absent | 0 |
| G 208 | Cl:100 | 0.46 | (0.07) | Absent | $1 \times 10^{-5}$ |
| G 209 | Cl:100 | 0.46 | (0.07) | Absent | $1 \times 10^{-5}$ |
| G 210 | Cl:100 | 0.46 | (0.07) | Absent | $1 \times 10^{-5}$ |
| G 211 | Cl:20(Br:80) | 0.46 | (0.08) | Absent | 0 |
| G 212 | Cl:98(Br:2) | 0.45 | (0.07) | Absent | 0 |
| G 213 | Cl:98(Br:2) | 0.45 | (0.07) | Absent | $1 \times 10^{-5}$ |
| G 214 | Cl:98(Br:2) | 0.45 | (0.07) | Absent | $1 \times 10^{-5}$ |
| G 215 | Cl:98(Br:2) | 0.45 | (0.07) | Absent | $1 \times 10^{-5}$ |
| G 216 | Cl:98(Br:2) | 0.45 | (0.07) | Absent | $1 \times 10^{-5}$ |
| G 217 | Cl:98(Br:2) | 0.45 | (0.07) | Absent | $1 \times 10^{-5}$ |
| G 218 | Cl:98(Br:2) | 0.45 | (0.07) | Present | $1 \times 10^{-5}$ |
| G 219 | Cl:100 | 0.46 | (0.07) | Absent | 0 |
| G 220 | Cl:100 | 0.46 | (0.07) | Absent | $1 \times 10^{-5}$ |
| G 221 | Cl:100 | 0.46 | (0.07) | Absent | $1 \times 10^{-5}$ |
| G 222 | Cl:100 | 0.46 | (0.07) | Absent | $1 \times 10^{-5}$ |

| Emulsion | Fe Ions-containing Layer in Grain | Ir (IV) Ions (mol/mol · Ag) | Ir Ions-containing Layer in Grain | Spectral Sensitizing Dye | Spectral Sensitizing (mol/mol · Ag) |
|---|---|---|---|---|---|
| G 201 | Absent | 0 | Absent | (h) | $(4 \times 10^{-4})$ |
| G 202 | Absent | 0 | Absent | (h) | $(4 \times 10^{-4})$ |
| G 203 | Uniformly in whole grain | 0 | Absent | (h) | $(4 \times 10^{-4})$ |
| G 204 | Core and 10% of surface | 0 | Absent | (h) | $(4 \times 10^{-4})$ |
| G 205 | 10% of surface | 0 | Absent | (h) | $(4 \times 10^{-4})$ |
| G 206 | 10% of surface | 0 | Absent | (h) | $(4 \times 10^{-4})$ |
| G 207 | Absent | 0 | Absent | (h) | $(4 \times 10^{-4})$ |
| G 208 | Uniformly in whole grain | 0 | Absent | (h) | $(4 \times 10^{-4})$ |
| G 209 | Core and 10% of surface | 0 | Absent | (h) | $(4 \times 10^{-4})$ |
| G 210 | 10% of surface | 0 | Absent | (h) | $(4 \times 10^{-4})$ |
| G 211 | Absent | $1 \times 10^{-7}$ | Uniformly in whole grain | (h) | $(4 \times 10^{-4})$ |
| G 212 | Absent | $1 \times 10^{-7}$ | Uniformly in whole grain | (h) | $(4 \times 10^{-4})$ |
| G 213 | Uniformly in whole grain | $1 \times 10^{-7}$ | Uniformly in whole grain | (h) | $(4 \times 10^{-4})$ |
| G 214 | Core and 10% of surface | $1 \times 10^{-7}$ | 10% of surface | (h) | $(4 \times 10^{-4})$ |
| G 215 | 10% of surface | $1 \times 10^{-7}$ | 90% of core of grain | (h) | $(4 \times 10^{-4})$ |
| G 216 | 10% of surface | $1 \times 10^{-7}$ | Uniformly in whole grain | (h) | $(4 \times 10^{-4})$ |
| G 217 | 10% of surface | $1 \times 10^{-7}$ | 10% of surface | (h) | $(4 \times 10^{-4})$ |
| G 218 | 10% of surface | $1 \times 10^{-7}$ | 10% of surface | (h) | $(4 \times 10^{-4})$ |
| G 219 | Absent | $1 \times 10^{-7}$ | Uniformly in whole grain | (h) | $(4 \times 10^{-4})$ |
| G 220 | Uniformly in whole grain | $1 \times 10^{-7}$ | Uniformly in whole grain | (h) | $(4 \times 10^{-4})$ |
| G 221 | Core and 10% of surface | $1 \times 10^{-7}$ | 10% of surface | (h) | $(4 \times 10^{-4})$ |
| G 222 | 10% of surface | $1 \times 10^{-7}$ | 10% of surface | (h) | $(4 \times 10^{-4})$ |

Note: All silver halide grains are cubic in shape.

TABLE 4-3

| Emulsion | Halide Composition (mol %) | Particle Size (μm) | Particle Distribution Coefficient | AgBr Localized Phase | Fe (II) Ions (mol/mol · Ag) |
|---|---|---|---|---|---|
| R 201 | Cl:20(Br:80) | 0.54 | (0.08) | Absent | 0 |

TABLE 4-3-continued

| | | | | | |
|---|---|---|---|---|---|
| R 202 | Cl:98(Br:2) | 0.53 | (0.07) | Absent | 0 |
| R 203 | Cl:98(Br:2) | 0.53 | (0.07) | Absent | $1 \times 10^{-5}$ |
| R 204 | Cl:98(Br:2) | 0.53 | (0.07) | Absent | $1 \times 10^{-5}$ |
| R 205 | Cl:98(Br:2) | 0.53 | (0.07) | Absent | $1 \times 10^{-5}$ |
| R 206 | Cl:98(Br:2) | 0.53 | (0.07) | Present | $1 \times 10^{-5}$ |
| R 207 | Cl:100 | 0.53 | (0.07) | Absent | 0 |
| R 208 | Cl:100 | 0.53 | (0.07) | Absent | $1 \times 10^{-5}$ |
| R 209 | Cl:100 | 0.53 | (0.07) | Absent | $1 \times 10^{-5}$ |
| R 210 | Cl:100 | 0.53 | (0.07) | Absent | $1 \times 10^{-5}$ |
| R 211 | Cl:20(Br:80) | 0.54 | (0.08) | Absent | 0 |
| R 212 | Cl:98(Br:2) | 0.53 | (0.07) | Absent | 0 |
| R 213 | Cl:98(Br:2) | 0.53 | (0.07) | Absent | $1 \times 10^{-5}$ |
| R 214 | Cl:98(Br:2) | 0.53 | (0.07) | Absent | $1 \times 10^{-5}$ |
| R 215 | Cl:98(Br:2) | 0.53 | (0.07) | Absent | $1 \times 10^{-5}$ |
| R 216 | Cl:98(Br:2) | 0.53 | (0.07) | Absent | $1 \times 10^{-5}$ |
| R 217 | Cl:98(Br:2) | 0.53 | (0.07) | Absent | $1 \times 10^{-5}$ |
| R 218 | Cl:98(Br:2) | 0.53 | (0.07) | Present | $1 \times 10^{-5}$ |
| R 219 | Cl:100 | 0.53 | (0.07) | Absent | 0 |
| R 220 | Cl:100 | 0.53 | (0.07) | Absent | $1 \times 10^{-5}$ |
| R 221 | Cl:100 | 0.53 | (0.07) | Absent | $1 \times 10^{-5}$ |
| R 222 | Cl:100 | 0.53 | (0.07) | Absent | $1 \times 10^{-5}$ |

| Emulsion | Fe Ions-containing Layer in Grain | Ir (IV) Ions (mol/mol · Ag) | Ir Ions-containing Layer in Grain | Spectral Sensitizing (Dye [mol/mol · Ag]) | |
|---|---|---|---|---|---|
| R 201 | Absent | 0 | Absent | (e) $(5 \times 10^{-5})$, | (f) $(1 \times 10^{-3})$ |
| R 202 | Absent | 0 | Absent | (e) $(5 \times 10^{-5})$, | (f) $(1 \times 10^{-3})$ |
| R 203 | Uniformly in whole grain | 0 | Absent | (e) $(5 \times 10^{-5})$, | (f) $(1 \times 10^{-3})$ |
| R 204 | Core and 10% of surface | 0 | Absent | (e) $(5 \times 10^{-5})$, | (f) $(1 \times 10^{-3})$ |
| R 205 | 10% of surface | 0 | Absent | (e) $(5 \times 10^{-5})$, | (f) $(1 \times 10^{-3})$ |
| R 206 | 10% of surface | 0 | Absent | (e) $(5 \times 10^{-5})$, | (f) $(1 \times 10^{-3})$ |
| R 207 | Absent | 0 | Absent | (e) $(5 \times 10^{-5})$, | (f) $(1 \times 10^{-3})$ |
| R 208 | Uniformly in whole grain | 0 | Absent | (e) $(5 \times 10^{-5})$, | (f) $(1 \times 10^{-3})$ |
| R 209 | Core and 10% of surface | 0 | Absent | (e) $(5 \times 10^{-5})$, | (f) $(1 \times 10^{-3})$ |
| R 210 | 10% of surface | 0 | Absent | (e) $(5 \times 10^{-5})$, | (f) $(1 \times 10^{-3})$ |
| R 211 | Absent | $1 \times 10^{-7}$ | Uniformly in whole grain | (e) $(5 \times 10^{-5})$, | (f) $(1 \times 10^{-3})$ |
| R 212 | Absent | $1 \times 10^{-7}$ | Uniformly in whole grain | (e) $(5 \times 10^{-5})$, | (f) $(1 \times 10^{-3})$ |
| R 213 | Uniformly in whole grain | $1 \times 10^{-7}$ | Uniformly in whole grain | (e) $(5 \times 10^{-5})$, | (f) $(1 \times 10^{-3})$ |
| R 214 | Core and 10% of surface | $1 \times 10^{-7}$ | 10% of surface | (e) $(5 \times 10^{-5})$, | (f) $(1 \times 10^{-3})$ |
| R 215 | 10% of surface | $1 \times 10^{-7}$ | 90% of core of grain | (e) $(5 \times 10^{-5})$, | (f) $(1 \times 10^{-3})$ |
| R 216 | 10% of surface | $1 \times 10^{-7}$ | Uniformly in whole grain | (e) $(5 \times 10^{-5})$, | (f) $(1 \times 10^{-3})$ |
| R 217 | 10% of surface | $1 \times 10^{-7}$ | 10% of surface | (e) $(5 \times 10^{-5})$, | (f) $(1 \times 10^{-3})$ |
| R 218 | 10% of surface | $1 \times 10^{-7}$ | 10% of surface | (e) $(5 \times 10^{-5})$, | (f) $(1 \times 10^{-3})$ |
| R 219 | Absent | $1 \times 10^{-7}$ | Uniformly in whole grain | (e) $(5 \times 10^{-5})$, | (f) $(1 \times 10^{-3})$ |
| R 220 | Uniformly in whole grain | $1 \times 10^{-7}$ | Uniformly in whole grain | (e) $(5 \times 10^{-5})$, | (f) $(1 \times 10^{-3})$ |
| R 221 | Core and 10% of surface | $1 \times 10^{-7}$ | 10% of surface | (e) $(5 \times 10^{-5})$, | (f) $(1 \times 10^{-3})$ |
| R 222 | 10% of surface | $1 \times 10^{-7}$ | 10% of surface | (e) $(5 \times 10^{-5})$, | (f) $(1 \times 10^{-3})$ |

Note: All silver halide grains are cubic in shape.

TABLE 5

| Layer | Main Composition | Amount used ($g/m^2$) |
|---|---|---|
| Seventh layer (Protective layer) | Gelatin | 1.33 |
| | Acryl-modified polymer of poly(vinyl alcohol) (degree of modification: 17%) | 0.17 |
| | Liquid paraffin | 0.03 |
| Sixth layer (UV absorbing layer) | Gelatin | 0.53 |
| | UV-absorbent (s) | 0.16 |
| | Solvent (t) | 0.08 |
| Fifth layer (Red-sensitive emulsion layer) | Silver halide emulsion (See Table 6) | 0.23 |
| | Gelatin | 1.34 |
| | Cyan coupler (u) | 0.32 |
| | Image-dye stabilizer (b) | 0.17 |
| | Image-dye stabilizer (c) | 0.40 |
| | Image-dye stabilizer (v) | 0.04 |
| | Solvent (w) | 0.15 |
| Fourth layer (UV absorbing layer) | Gelatin | 1.58 |
| | UV-absorbent (s) | 0.47 |
| | Color-mix preventing agent (k) | 0.05 |
| | Solvent (t) | 0.24 |
| Third layer (Green-sensitive emulsion layer) | Silver halide emulsion (see Table 6) | 0.12 |

TABLE 5-continued

| Layer | Main Composition | Amount used ($g/m^2$) |
|---|---|---|
| | Gelatin | 1.24 |
| | Magenta coupler (m) | 0.20 |
| | Image-dye stabilizer (n) | 0.03 |
| | Image-dye stabilizer (o) | 0.15 |
| | Image-dye stabilizer (p) | 0.02 |
| | Image-dye stabilizer (q) | 0.02 |
| | Solvent (r) | 0.40 |
| Second layer (Color-mix preventing layer) | Gelatin | 0.99 |
| | Color-mix preventing agent (k) | 0.08 |
| | Solvent (d) | 0.16 |
| | Solvent (l) | 0.08 |
| First layer (Blue-sensitive emulsion layer) | Silver halide emulsion (see Table 6) | 0.30 |
| | Gelatin | 1.86 |
| | Yellow coupler (i) | 0.82 |
| | Image-dye stabilizer (j) | 0.19 |
| | Image-dye stabilizer (c) | 0.06 |
| | Solvent (d) | 0.35 |
| Supporting base | Polyethylene laminated paper ($TiO_2$ and marine blue are cotained in the polyethylene film of first layer side) | |

Compounds used are as follows:
(b), (c), and (d) are the same as in Example 1.

-continued
(i) Yellow coupler
Mixture (1:1 in molar ratio) of
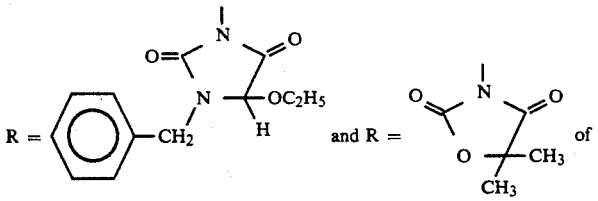
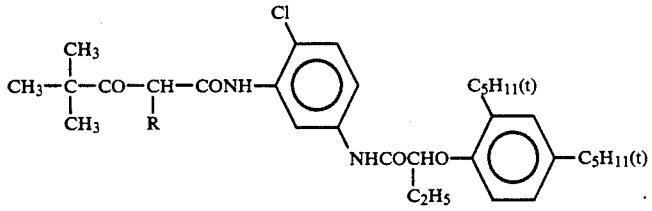
(j) Image-dye stabilizer
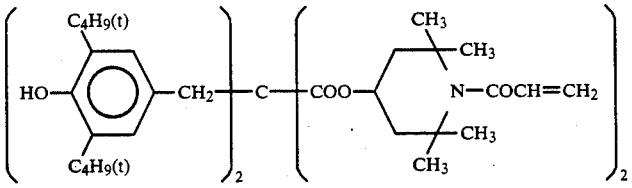
(k) Color-mix inhibitor
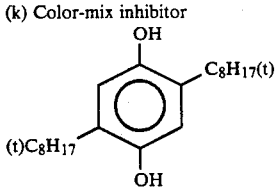
(l) Solvent
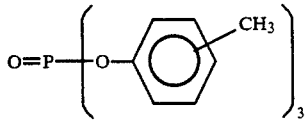
(m) Magenta coupler
Mixture (1:1 in molar ratio) of
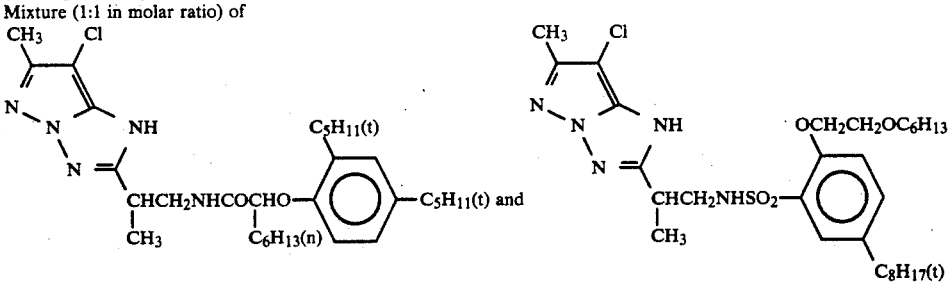
(n) Image dye stabilizer
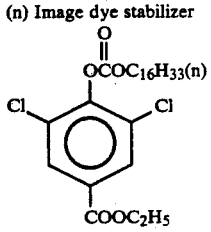
(o) Image-dye stabilizer -continued
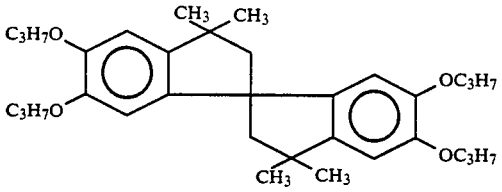
(p) Image dye stabilizer
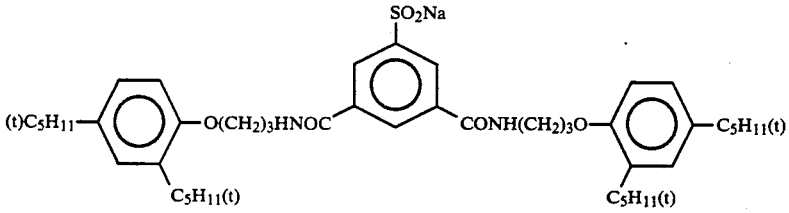
(q) Image-dye stablilizer
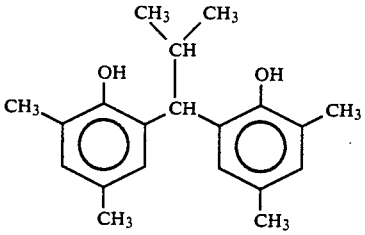
(r) Solvent
Mixture (2:1 in weight ratio) of
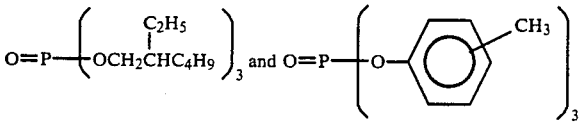
(s) UV-absorbent
Mixture (4:2:4 in weight ratio) of
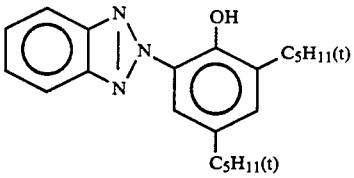
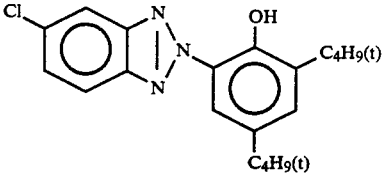
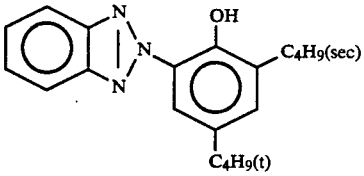
(t) Solvent
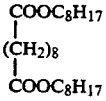
(u) Cyan coupler
Mixture (4:2:4 in weight ratio) of
R = $C_2H_5$ and $C_4H_9$ of -continued

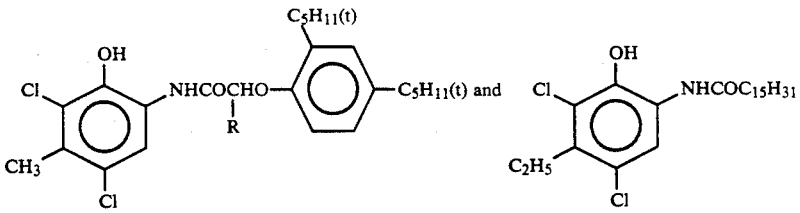

(v) Image-dye stabilizer

Mixture (1:1 in weight ratio) of

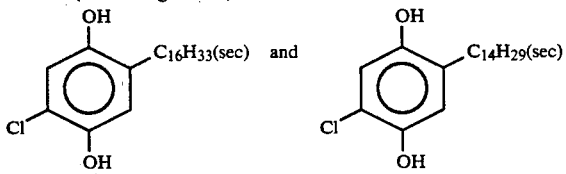

(w) Solvent

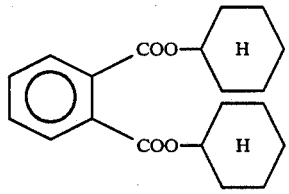

TABLE 6

| Sample | Emulsion for Blue-sensitive Layer | Emulsion for Green-sensitive Layer | Emulsion for Red-sensitive Layer |
|---|---|---|---|
| 201 | B-201 | G-201 | R-201 |
| 202 | B-202 | G-202 | R-202 |
| 203 | B-203 | G-203 | R-203 |
| 204 | B-204 | G-204 | R-204 |
| 205 | B-205 | G-205 | R-205 |
| 206 | B-206 | G-206 | R-206 |
| 207 | B-207 | G-207 | R-207 |
| 208 | B-208 | G-208 | R-208 |
| 209 | B-209 | G-209 | R-209 |
| 210 | B-210 | G-210 | R-210 |
| 211 | B-211 | G-211 | R-211 |
| 212 | B-212 | G-212 | R-212 |
| 213 | B-213 | G-213 | R-213 |
| 214 | B-214 | G-214 | R-214 |
| 215 | B-215 | G-215 | R-215 |
| 216 | B-216 | G-216 | R-216 |
| 217 | B-217 | G-217 | R-217 |
| 218 | B-218 | G-218 | R-218 |
| 219 | B-219 | G-219 | R-219 |

TABLE 6-continued

| Sample | Emulsion for Blue-sensitive Layer | Emulsion for Green-sensitive Layer | Emulsion for Red-sensitive Layer |
|---|---|---|---|
| 220 | B-220 | G-220 | R-220 |
| 221 | B-221 | G-221 | R-221 |
| 222 | B-222 | G-222 | R-222 |

Further, 1-(5-methylureidophenyl)-5-mercaptotetrazole was added to the blue-sensitive emulsion layer, the green-sensitive emulsion layer, and the red-sensitive emulsion layer in amounts of $8.5\times10^{-5}$ mol, $7.7\times10^{-4}$ mol, and $2.5\times10^{-4}$ mol per mol of silver halide, respectively.

Further, 4-hydroxy-6-methyl-1,3,3a,7-tetrazaindene was added to the blue-sensitive emulsion layer and the green-sensitive layer in amounts of $1\times10^{-4}$ mol and $2\times10^{-4}$ per mol of silver halide, respectively.

Dyes shown below were added to emulsion layers for preventing irradiation:

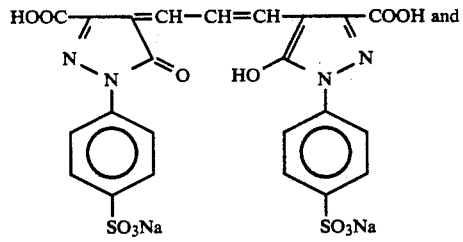

-continued

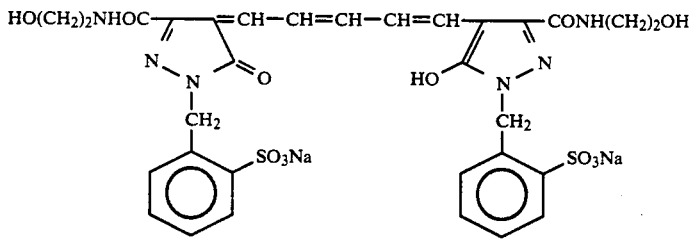

Thus-prepared 12 kinds of coated samples were subjected to the same test as in Example 1, except that the exposure to light of each sample was effected through three filters of blue, green, and red to investigate the performance of blue-sensitive, green-sensitive, and red-sensitive emulsion layer, respectively.

For the developing process of samples the following steps and processing solutions were used.

Results are shown in Table 7.

| Processing Step | Temperature | Time | Replenisher* | Tank Volume |
|---|---|---|---|---|
| Color Developing | 35° C. | 20 sec., 45 sec. | 161 ml | 17 l |
| Bleach-fixing | 30–35° C. | 45 sec. | 215 ml | 17 l |
| Rinsing ① | 30–35° C. | 20 sec. | — | 10 l |
| Rinsing ② | 30–35° C. | 20 sec. | — | 10 l |
| Rinsing ③ | 30–35° C. | 20 sec. | 350 ml | 10 l |
| Drying | 70–80° C. | 60 sec. | | |

Note:
*replenisher amount ml/m² of photographic material

The rinsing steps were carried out in a 3-tanks countercurrent mode from the tank of rinsing ③ towards the tank of rinsing ①.

The composition of each processing solution was as follows:

-continued

| Color developer | Solution | Tank | Replenisher |
|---|---|---|---|
| Water | | 800 ml | 800 ml |
| Ethylenediamine-N,N,N,N-tetramethylene phosphonic acid | | 1.5 g | 2.0 g |
| Potassium bromide | | 0.015 g | |
| Triethanolamine | | 8.0 g | 12.0 g |
| Sodium chloride | | 1.4 g | — |
| Potassium carbonate | | 25 g | 25 g |
| N-Ethyl-N-(β-methanesulfonamidoethyl)-3-methyl-4-aminoaniline sulfate | | 5.0 g | 7.0 g |
| N,N-bis(carboxymethyl)hydrazine | | 5.5 g | 7.0 g |
| Fluorescent whitening agent (WHITEX-4, made by Sumitomo Chemical Ind.) | | 1.0 g | 2.0 g |
| Water to make | | 1000 ml | 1000 ml |
| pH | | 10.05 | 10.45 |

Bleach-fixing solution
(Both tank solution and replenisher)

| | |
|---|---|
| Water | 400 ml |
| Ammonium thiosulfate (70%) | 120 ml |
| Sodium sulfite | 17 g |
| Iron (III) ammonium ethylenediaminetetraacetate | 55 g |
| Disodium ethylenediaminetetraacetate | 5 g |
| Ammonium bromide | 40 g |
| Water to make | 1000 ml |
| pH (25° C.) | 6.0 |

Rinsing solution
(both tank solution and replenisher)

Ion-exchanged water (each content of calsium and magnesium was 3 ppm or below)

TABLE 7 - 1

| Sample | Layer | 0.1 sec. Exposure to Light: 20 sec. Development S* | 20 sec. Development Contrast | 45 sec. Development S* | 45 sec. Development Contrast | 0.01 sec. Exposure: 45 sec. Development S* | 45 sec. Development Contrast | Increment of Density** | Decrement of Sensitivity due to Pressure | Remarks |
|---|---|---|---|---|---|---|---|---|---|---|
| 201 | B | 14 | 0.57 | 100 | 0.89 | 65 | 0.73 | +0.02 | ◎ | Comparative Example |
| | G | 22 | 0.62 | 100 | 0.91 | 68 | 0.75 | +0.01 | ◎ | Comparative Example |
| | R | 25 | 0.68 | 100 | 0.96 | 68 | 0.78 | −0.02 | ◎ | Comparative Example |
| 202 | B | 45 | 1.64 | 68 | 1.71 | 43 | 1.39 | +0.02 | ◎ | Comparative Example |
| | G | 48 | 1.72 | 73 | 1.77 | 47 | 1.44 | +0.03 | ◎ | Comparative Example |
| | R | 41 | 1.75 | 59 | 1.82 | 38 | 1.49 | −0.01 | ◎ | Comparative Example |
| 203 | B | 65 | 1.68 | 96 | 1.79 | 67 | 1.50 | +0.03 | X | Comparative Example |
| | G | 68 | 1.71 | 102 | 1.83 | 76 | 1.55 | +0.02 | X | Comparative Example |
| | R | 56 | 1.81 | 81 | 1.90 | 60 | 1.64 | +0.01 | X | Comparative Example |
| 204 | B | 101 | 1.70 | 135 | 1.81 | 105 | 1.52 | +0.02 | X | Comparative Example |
| | G | 104 | 1.73 | 138 | 1.85 | 108 | 1.57 | +0.01 | X | Comparative Example |
| | R | 95 | 1.83 | 131 | 1.92 | 102 | 1.67 | +0.00 | X | Comparative Example |
| 205 | B | 148 | 2.16 | 201 | 2.25 | 174 | 2.13 | +0.02 | ◎ | Comparative Example |
| | G | 157 | 2.21 | 211 | 2.30 | 183 | 2.14 | +0.02 | ◎ | Comparative Example |
| | R | 149 | 2.26 | 199 | 2.37 | 173 | 2.22 | −0.02 | ◎ | Comparative Example |
| 206 | B | 178 | 2.13 | 241 | 2.23 | 212 | 2.11 | +0.03 | ○-◎ | Comparative Example |
| | G | 189 | 2.17 | 255 | 2.28 | 225 | 2.12 | +0.02 | ○-◎ | Comparative Example |
| | R | 175 | 2.23 | 237 | 2.35 | 208 | 2.20 | +0.01 | ○-◎ | Comparative Example |

Note:
*Sensitivity (Relative value assumed sensitivity of each layer of sample 201 as 100)
**Increment of density for 2 hours between an exposure to light and development processing.

TABLE 7 - 2

| Sample | Layer | 0.1 sec. Exposure to Light, 20 sec. Development S* | Contrast | 0.1 sec. Exposure to Light, 45 sec. Development S* | Contrast | 0.01 sec. Exposure, 45 sec. Development S* | Contrast | Increment of Density** | Decrement of Sensitivity due to Pressure | Remarks |
|---|---|---|---|---|---|---|---|---|---|---|
| 207 | B | 40 | 1.59 | 66 | 1.68 | 39 | 1.33 | +0.03 | ◎ | Comparative Example |
| | G | 45 | 1.66 | 70 | 1.74 | 44 | 1.39 | +0.02 | ◎ | Comparative Example |
| | R | 38 | 1.71 | 56 | 1.82 | 35 | 1.47 | −0.02 | ◎ | Comparative Example |
| 208 | B | 62 | 1.64 | 91 | 1.76 | 66 | 1.49 | +0.02 | X | Comparative Example |
| | G | 65 | 1.70 | 95 | 1.81 | 71 | 1.55 | +0.03 | X | Comparative Example |
| | R | 57 | 1.78 | 85 | 1.89 | 63 | 1.63 | +0.00 | X | Comparative Example |
| 209 | B | 63 | 1.66 | 94 | 1.78 | 74 | 1.51 | +0.02 | X | Comparative Example |
| | G | 66 | 1.72 | 97 | 1.83 | 77 | 1.57 | +0.02 | X | Comparative Example |
| | R | 67 | 1.81 | 102 | 1.91 | 78 | 1.66 | +0.01 | X | Comparative Example |
| 210 | B | 127 | 2.12 | 163 | 2.24 | 142 | 2.07 | +0.03 | ◎ | Comparative Example |
| | G | 129 | 2.17 | 165 | 2.29 | 148 | 2.13 | +0.02 | ◎ | Comparative Example |
| | R | 143 | 2.28 | 182 | 2.37 | 158 | 2.21 | −0.01 | ◎ | Comparative Example |
| 211 | B | 11 | 0.94 | 74 | 1.02 | 71 | 0.91 | +0.04 | ◎ | Comparative Example |
| | G | 17 | 0.96 | 73 | 1.04 | 71 | 0.93 | +0.04 | ◎ | Comparative Example |
| | R | 19 | 1.03 | 72 | 1.09 | 70 | 0.97 | +0.02 | ◎ | Comparative Example |
| 212 | B | 35 | 2.06 | 51 | 2.15 | 48 | 2.12 | +0.46 | ◎ | Comparative Example |
| | G | 38 | 2.16 | 55 | 2.24 | 52 | 2.21 | +0.47 | ◎ | Comparative Example |
| | R | 31 | 2.24 | 44 | 2.32 | 42 | 2.29 | +0.44 | ◎ | Comparative Example |

Note:
*Sensitivity (Relative value assumed sensitivity of each layer of sample 201 as 100)
**Increment of density for 2 hours between an exposure to light and development processing.

TABLE 7 - 3

| Sample | Layer | 0.1 sec. Exposure to Light, 20 sec. Development S* | Contrast | 0.1 sec. Exposure to Light, 45 sec. Development S* | Contrast | 0.01 sec. Exposure, 45 sec. Development S* | Contrast | Increment of Density** | Decrement of Sensitivity due to Pressure | Remarks |
|---|---|---|---|---|---|---|---|---|---|---|
| 213 | B | 61 | 1.79 | 82 | 1.87 | 80 | 1.85 | +0.41 | X | Comparative Example |
| | G | 65 | 1.88 | 88 | 1.96 | 86 | 1.93 | +0.42 | X | Comparative Example |
| | R | 57 | 1.95 | 76 | 2.03 | 74 | 2.01 | +0.39 | X | Comparative Example |
| 214 | B | 56 | 1.95 | 86 | 2.04 | 84 | 2.02 | +0.24 | X | Comparative Example |
| | G | 59 | 2.04 | 91 | 2.13 | 98 | 2.10 | +0.26 | X | Comparative Example |
| | R | 52 | 2.11 | 81 | 2.20 | 80 | 2.18 | +0.22 | X | Comparative Example |
| 215 | B | 125 | 2.27 | 171 | 2.36 | 169 | 2.33 | +0.37 | ◎ | Comparative Example |
| | G | 133 | 2.33 | 180 | 2.41 | 177 | 2.39 | +0.38 | ◎ | Comparative Example |
| | R | 127 | 2.39 | 169 | 2.49 | 167 | 2.46 | +0.35 | ◎ | Comparative Example |
| 216 | B | 137 | 2.27 | 186 | 2.37 | 184 | 2.34 | +0.27 | ◎ | Comparative Example |
| | G | 145 | 2.32 | 195 | 2.41 | 192 | 2.39 | +0.28 | ◎ | Comparative Example |
| | R | 138 | 2.48 | 184 | 2.50 | 183 | 2.48 | +0.26 | ◎ | Comparative Example |
| 217 | B | 146 | 2.27 | 200 | 2.36 | 183 | 2.33 | +0.04 | ◎ | This Invention |
| | G | 156 | 2.32 | 210 | 2.41 | 191 | 2.38 | +0.04 | ◎ | This Invention |
| | R | 149 | 2.38 | 198 | 2.49 | 182 | 2.47 | +0.02 | ◎ | This Invention |
| 218 | B | 177 | 2.24 | 239 | 2.33 | 237 | 2.30 | +0.01 | ○-◎ | Thsi Invention |
| | G | 187 | 2.29 | 253 | 2.38 | 251 | 2.35 | +0.02 | ○-◎ | This Invention |
| | R | 174 | 2.35 | 234 | 2.46 | 232 | 2.43 | +0.01 | ○-◎ | This Invention |

Note:
*Sensitivity (Relative value assumed sensitivity of each layer of sample 201 as 100)
**Increment of density for 2 hours between an exposure to light and development processing.

TABLE 7 - 4

| Sample | Layer | 0.1 sec. Exposure to Light, 20 sec. Development S* | Contrast | 0.1 sec. Exposure to Light, 45 sec. Development S* | Contrast | 0.01 sec. Exposure, 45 sec. Development S* | Contrast | Increment of Density** | Decrement of Sensitivity due to Pressure | Remarks |
|---|---|---|---|---|---|---|---|---|---|---|
| 219 | B | 30 | 1.99 | 49 | 2.09 | 45 | 2.05 | +0.50 | ◎ | Comparative Example |
| | G | 34 | 2.06 | 52 | 2.15 | 47 | 2.12 | +0.52 | ◎ | Comparative Example |
| | R | 29 | 2.19 | 42 | 2.24 | 37 | 2.21 | +0.48 | ◎ | Comparative Example |
| 220 | B | 53 | 1.79 | 78 | 1.90 | 75 | 1.88 | +0.46 | X | Comparative Example |
| | G | 56 | 1.87 | 81 | 1.98 | 78 | 1.95 | +0.46 | X | Comparative Example |
| | R | 49 | 1.94 | 72 | 2.02 | 69 | 1.99 | +0.42 | X | Comparative Example |
| 221 | B | 58 | 1.92 | 87 | 2.01 | 85 | 1.98 | +0.25 | X | Comparative Example |
| | G | 61 | 2.04 | 90 | 2.13 | 88 | 2.10 | +0.26 | X | Comparative Example |
| | R | 62 | 2.11 | 95 | 2.21 | 93 | 2.18 | +0.25 | X | Comparative Example |
| 222 | B | 124 | 2.22 | 161 | 2.31 | 159 | 2.30 | +0.04 | ◎ | This Invention |
| | G | 126 | 3.27 | 163 | 2.36 | 160 | 2.33 | +0.04 | ◎ | This Invention |
| | R | 146 | 2.41 | 180 | 2.49 | 178 | 2.46 | +0.02 | ◎ | This Invention |

Note:
*Sensitivity (Relative value assumed sensitivity of each layer of sample 201 as 100)
**Increment of density for 2 hours between an exposure to light and development processing.

As is apparent from the results, the effect of the present invention is also remarkable in multilayered color photographic materials. That is, in Sámples 201 to 211, prepared using emulsions having a silver bromide content of 80 mol %, although the change of sensitivity and contrast at the time when illuminance of exposure changes can be improved by introducing iridium ions without causing such impairment as latent image sensitization, the development is slow and therefore these emulsions cannot be used practically.

In contrast, in samples using silver halide emulsions having a silver chloride content of 98% or 100%, although the developing speed increases greatly and rapid processing becomes possible, as in Samples 202 or 207, wherein only the silver chloride ratio is increased, the sensitivity is low and the sensitivity and contrast drop at high illuminance, so that they cannot be used practically.

Although the introduction of iron ions increases sensitivity, lessens reciprocity law failure, and lowers the change in sensitivity due to a change of temperature at the time of exposure, desensitization occurs when pressure is applied.

Although emulsions containing iron ions concentrated on the grain surface layer can prevent desensitization that will otherwise occur when pressure is applied, the contrast, particularly at the shoulder at high-illuminance exposure, becomes insufficient.

On the other hand, as can be understood from Samples 212 or 219, for high-intensity failure of high-silver-chloride emulsions, the introduction of iridium ions exhibits a remarkable effect. However, when iridium ions are introduced into high-silver chloride emulsions, remarkable latent-image sensitization occurs, and therefore it is not practically applicable.

As in the present emulsions, only by using high-silver chloride emulsions wherein iridium ions are contained in iron ion localized layers, multilayer color photographic materials excellent in rapid processibility, high in sensitivity and contrast, excellent in pressure resistance, less in the change of sensitivity due to a change of illuminance at the time of exposure, and having adequate contrast at the shoulder can be obtained.

Further, in Sample 218, which has silver bromide in silver halide as localized phases, high sensitivity can be obtained, the extent of latent image sensitization is small, and more excellent performance can be exhibited.

Having described our invention as related to the embodiment, it is our intention that the invention be not limited by any of the details of the description, unless otherwise specified, but rather be construed broadly within its spirit and scope as set out in the accompanying claims.

What we claim is:

1. A surface latent image type-silver halide emulsion comprising silver halide grains of silver chloride or silver chlorobromide, 90 mol % or more of which is silver chloride, and which is substantially free from silver iodide, wherein the silver halide grains contain iron ions is an amount of $1\times10^{-7}$ to $1\times10^{-3}$ mol and iridium ions in an amount of $1\times10^{-9}$ to $1\times10^{-5}$ mol, per mol of the silver halide, wherein the silver halide grains comprise a core and a surface, the surface amounting to no more than 50% of the grain volume and wherein the iron ions are supplied together with an aqueous silver salt solution and an aqueous halide solution to form the surface layer such that the concentration of the iron ions in the surface will be at least 10 times that of the core, and wherein 80% or more of the iridium ions are contained in the iron ion localized phases.

2. The silver halide emulsion as claimed in claim 1, wherein the silver halide is silver chlorobromide having silver bromide localized phases with a silver bromide content of 10 to 70 mol % within or on the surface of the silver halide grains.

3. The silver halide emulsion as claimed in claim 1, wherein the silver chloride content in the silver halide grains is 95 mol % or more.

4. The silver halide emulsion as claimed in claim 1, wherein the silver iodide content in the silver halide grains is 0.5 mol % or less.

5. The silver halide emulsion as claimed in claim 1, wherein iron ions are incorporated into the silver halide emulsion grains by adding a water-soluble iron compound to a reaction vessel when the silver halide emulsion grain is formed.

6. The silver halide emulsion as claimed in claim 5, wherein the iron compound is selected from the group consisting of ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ferrous ammonium nitrate, basic ferric acetate, ferric albuminate, ferric ammonium acetate, ferric bromide, ferric chloride, ferric chromate, ferric citrate, ferric fluoride, ferric formate, ferric glycerophosphate, ferric hydroxide, acidic ferric phosphate, ferric nitrate, ferric phosphate, ferric pyrophosphate, sodium ferric pyrophosphate, ferric thiocyanate, ferric sulfate, ammonium ferric sulfate, guanidium ferric sulfate, ammonium ferric citrate, potassium hexacyanoferrate(II), potassium pentacyanoammineferrate(II), sodium iron(III) ethylenedinitrilotetraacetic acetate, potassium hexacyanoferrate(III), iron(III) tris(pipyridyl) chloride, and potassium pentacyanonitrosylferrate(III).

7. The silver halide emulsion as claimed in claim 1, wherein the content of iron ions in the silver halide grains is $1\times10^{-6}$ to $1\times10^{-4}$ mol per mol of silver halide.

8. The silver halide emulsion as claimed in claim 1, wherein the iron ion localized phase is present in the surface layer of the silver halide grain which occupies 40% or less the grain volume.

9. The silver halide emulsion as claimed in claim 1, wherein iridium ions are incorporated into the silver halide emulsion grains by adding a water-soluble iridium compound to a reaction vessel during formation of the silver halide emulsion grain.

10. The silver halide emulsion as claimed in claim 9, wherein iridium compound is selected from the group consisting of an iridium (III) halide compound, an iridium (IV) halide compound, and an iridium complex salt having halogens, amines or oxalate as at least one ligand.

11. The silver halide emulsion as claimed in claim 1, wherein the content of iridium ions in the silver halide grains is $5\times10^{-9}$ to $1\times10^{-6}$ mol per mol of silver halide.

12. The silver halide emulsion as claimed in claim 1, wherein all of the iridium ions added are contained in the iron ion localized phases.

13. A silver halide photographic material comprising a support having thereon at least one photosensitive emulsion layer, said emulsion layer comprising the silver halide emulsion as claimed in claim 1.

* * * * *

UNITED STATES PATENT AND TRADEMARK OFFICE

CERTIFICATE OF CORRECTION

PATENT NO. : 5,166,044

DATED : November 24, 1992

INVENTOR(S) : Asami

It is certified that error appears in the above-identified patent and that said Letters Patent is hereby corrected as shown below:

In column 71, line 64, delete "supplied" and insert therefor --applied--.

Signed and Sealed this

Eighteenth Day of January, 1994

*Attest:*

Bruce Lehman

BRUCE LEHMAN

*Attesting Officer*

*Commissioner of Patents and Trademarks*